United States Patent [19]

Adams et al.

[11] Patent Number: 4,688,488

[45] Date of Patent: Aug. 25, 1987

[54] AUTOMATIC ACTUATING AND LOCKING APPARATUS FOR THE HOPPER DOORS OF A RAILROAD HOPPER CAR

[75] Inventors: Norman S. Adams; Robert E. Molloy, both of Cincinnati, Ohio

[73] Assignee: Avondale Industries, Inc., New York, N.Y.

[21] Appl. No.: 799,634

[22] Filed: Nov. 19, 1985

[51] Int. Cl.[4] ..... B61D 7/26

[52] U.S. Cl. ..... 105/253; 105/240; 105/290; 105/313; 298/8 H; 298/30

[58] Field of Search ..... 105/247, 248, 253, 288, 105/289, 290, 310, 313, 240; 298/8 H, 30

[56] References Cited

U.S. PATENT DOCUMENTS

| | | | |
|---|---|---|---|
| 3,187,684 | 6/1965 | Ortner | 105/248 |
| 3,596,609 | 8/1971 | Ortner et al. | 105/240 |
| 3,772,996 | 11/1973 | Schuller | 105/240 |
| 4,084,515 | 4/1978 | Kunz et al. | 105/240 |
| 4,132,177 | 1/1979 | Funk | 105/310 |
| 4,224,877 | 9/1980 | Stark et al. | 105/250 |
| 4,284,011 | 8/1981 | Eagle | 105/310 |
| 4,366,757 | 1/1983 | Funk | 105/248 |
| 4,508,037 | 4/1985 | Rousseau | 105/290 |
| 4,601,244 | 7/1986 | Fischer | 105/240 |

*Primary Examiner*—Randolph A. Reese
*Attorney, Agent, or Firm*—Frost & Jacobs

[57] ABSTRACT

Apparatus for actuating and locking the hopper doors of a hopper car of the type having a center sill of inverted U-shaped cross section and a plurality of hopper doors extending transversely of the center sill. The hopper doors can be arranged singly to close a chute, in opposed cooperating pairs, and both. The actuating and locking apparatus of the present invention comprises a shaft extending transversely of the center sill and located between adjacent pairs of hopper doors when the hopper doors are so arranged and adjacent each single hopper door when present. Each such shaft is rotatively mounted. A lever is mounted on each shaft. Each lever has an arm for each door to which it is adjacent and a link pivotally connected to each such arm and the adjacent hopper door. Each lever also has an upright arm extending into the center sill and pivotally affixed to a segmented actuating beam located within the center sill and extending longitudinally therein. A cylinder and piston is located within the center sill and the free end of the piston is operatively connected to one end of the actuating beam. The piston and actuating beam are shiftable longitudinally between a first position wherein the levers, links and hopper doors are maintained in an over-center, locked, door-closed position, and a second position wherein the levers, links and hopper doors are rotated over-center to a door-open position. A latch may also be provided to lock the piston and the beam in the first door-closed position.

33 Claims, 26 Drawing Figures

AUTOMATIC ACTUATING AND LOCKING APPARATUS FOR THE HOPPER DOORS OF A RAILROAD HOPPER CAR

TECHNICAL FIELD

The invention relates to an improved automatic door actuating and locking mechanism for the hopper doors of a railroad hopper car, and more particularly to such a mechanism for modern hopper cars capable of high speed discharge of their loads.

BACKGROUND ART

In recent years railroad hopper cars have been developed of increased size and of greatly increased capacity. In their most usual form, these hopper cars are provided with a plurality of cooperating opposed pairs of hopper doors, arranged transversely of the longitudinal axis of the center sill of the car and extending substantially the full length of the car. The pairs of doors, when opened, open essentially the entire bottom of the car enabling very rapid discharge of the lading.

In the newer, larger and more advanced types of hopper cars under consideration herein, the increased size of the cars has resulted in hopper doors which are also larger and heavier. As a result, manually operable door actuating and locking means have been devised for such cars, as is exemplified by the teachings of U.S. Pat. No. 4,366,757. Automatic means for opening and closing the hopper doors have also been devised. U.S. Pat. Nos. 3,187,684 and 3,596,609 teach exemplary automatic hopper door opening and closing mechanisms.

The present application relates to automatic means for opening, closing and locking the hopper doors of hopper cars of the newer and more advanced type mentioned above. The hopper door actuating and locking apparatus of the present invention represents an improvement over that taught in the above mentioned U.S. Pat. Nos. 3,187,684 and 3,596,609.

The present invention provides hopper door actuating and locking apparatus which is simpler in construction and requires fewer parts. A major portion of the apparatus, including the actuating cylinder, is located within the center sill for greater protection.

The actuating apparatus of the present invention opens and closes all of the doors simultaneously. The apparatus of the present invention employs a segmented actuating beam. Such a segmented beam is known per se. Nevertheless, the actuating apparatus of the present invention is characterized by numerous improvements and advantages over the prior art structures. A smaller diameter cylinder can be used and less piston stroke is required, thus reducing the amount of air needed. Furthermore, the lever system of the present invention is characterized by a greater mechanical advantage than hitherto achieved. The actuating aparatus is more accessble and is more easily adjusted.

The actuating and locking apparatus of the present invention is capable of operating hopper doors arranged both in opposed pairs and singly in combination with a chute. This enables the apparatus of the present invention to be used on hopper cars having a wide variety of hopper door arrangements, as will be described hereinafter.

DISCLOSURE OF THE INVENTION

According to the invention there is provided apparatus for actuating and locking the hopper doors of a hopper car. The hopper car is of the type having a center sill of inverted U-shaped cross section and a plurality of hopper doors extending transversely of the hopper car center sill.

The hopper doors can be arranged singly, in opposed cooperating pairs, and both. Each hopper door comprises a pair of closure panels, lying to each side of the center sill, and joined together by appropriate bracing members. When a hopper door is used singly, its closure panels close openings in a chute. When the hopper doors are used in opposed pairs, each closure panel cooperates with substantially triangular inner and outer hopper sheets.

The actuating and locking apparatus of the present invention comprises a shaft located between adjacent pairs of opposed hopper doors when the doors are so arranged, and adjacent each single hopper door, when present. Each shaft is rotatively mounted at its ends in brackets which depend from the center sill, each shaft extending transversely of the center sill. A lever is mounted on each shaft, and each lever has an arm for each door to which it is adjacent. A link is pivotally connected at its ends to each such lever arm and its adjacent hopper door.

Each lever also has an upright arm extending into the center sill and pivotally conntected to a segmented beam located within the center sill and extending longitudinally thereof. A cylinder and piston is preferably located within the center sill and the free end of the piston is operatively connected to one end of the beam. The piston and beam are shiftable longitudinally between a first position wherein all of the levers, links and hopper doors are maintained in an over-center, locked, door-closed condition, and a second position wherein the levers, links and hopper doors are rotated over-center to a door-open condition.

A latch is also provided to lock the piston and beam in the first door-closed position.

In some instances it may be desirable to use a center lever and a pair of door levers on each shaft, instead of a single lever, as will be described hereinafter.

BRIEF DSCRIPTION OF THE DRAWINGS

DETAILED DESCRIPTION OF THE INVENTION

Figure 1:
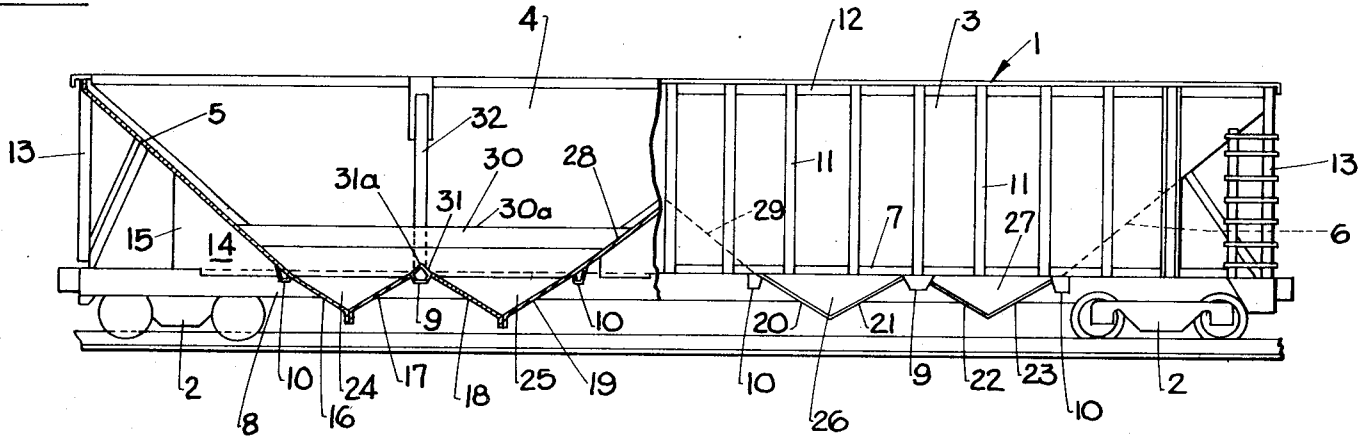
FIG. 1 is a side elevational view, partly in cross section, illustrating an exemplary hopper car of the type to which the present invention can be applied.

While the teachings of the present invention can be applied to hopper cars having various hopper door arrangements, as will be evident hereinafter, for purposes of an exemplary showing FIG. 1 illustrates a modern hopper car of the type having four pairs of cooperating hopper doors and a center sill extending throughout the length of the car.

The hopper car comprises an elongated body generally indicated at 1 and mounted on conventional trucks 2. The body comprises vertical sides 3 and 4, with inclined end walls 5 and 6, conventionally called slope sheets.

The car body is provided with a base frame work comprising elongated side frame members or side sills (one of which is shown at 7), a longitudinally extending center frame member or center sill 8, and a plurality of additional frame members 9 and 10 extending transversely of the car body from the center sill 8 to the side sills. It will be understood by one skilled in the art that the ends of the car frame are provided with suitable bracing members, not shown. The sides 3 and 4 of the car are provided with a plurality of vertical braces generally indicated at 11, which extend upwardly from the side sill 7 to the top chord 12. The ends of the car body also have vertical brace members, generally indicated at 13. The slope sheets 5 and 6 are additionally supported by a plurality of triangular braces 14, one of which is shown in FIG. 1. The braces 14 extending upwardly from the base frame of the car body to the slope sheets 5 and 6. The vertical edges of the triangular braces 14 support a vertical panel or body bolster web 15, one of which is shown in FIG. 1.

In the exemplary car illustrated in FIG. 1, the discharge openings of the car bottom are closed by cooperating, opposed pairs of doors 16–17, 18–19, 20–21, and 22–23. As will be apparent hereinafter from FIG. 2, each of the doors 16–23 is made up of two separate panels so as to make room for the center sill 8. Each of the doors 16–23 is hingedly affixed to and supported by an appropriate one of the transverse frame members 9 and 10 and is swingable between a closed position illustrated in FIG. 1 and a downwardly depending open position. Each opposed pair of hopper doors 16–17, 18–19, 20–21 and 22–23 cooperates with a pair of inner hopper sheets located to each side of center sill 8. Two such inner hopper sheets are shown at 24 and 25. Similarly, each opposed pair of hopper doors also cooperates with a pair of outer hopper sheets affixed to the side sills 7. Two such outer hopper sheets are shown at 26 and 27. The cooperating hopper door pairs 18–19 and 20–21 are, in the exemplary car illustrated, separated by a pair of slope sheets 28 and 29.

The center sill 8 may be provided with a hood or cover 30 having inclined wall surfaces tapering outwardly and downwardly from a ridge 30*a*. The frame elements 9 extending transversely between adjacent pairs of hopper doors may similarly be provided with hoods or covers 31 having inclined wall surfaces tapering downwardly and outwardly from ridges 31*a*. The hoods or covers 30 and 31 serve not only to break up the load, but also to guide it during the discharge operation. The transversely extending supports 9 can be additionally supported by struts, one of which is shown at 32. The struts 32 extend upwardly and outwardly from the frame members 9 to the car body sides 3 and 4. Preferably, the struts are tubular in configuration, being of circular cross section so as to provide maximum strength and minimum resistance to the discharge flow of the car load.

The transversely extending frame members 9 and 10 differ slightly in configuration. This is due to the fact that the frame members 9 are located between pairs of hopper doors, while the frame members 10 are located at the lowermost edges of slope sheets 5, 6, 28 and 29. The frame members 9 are generally U-shaped in cross section, the legs of the U-shaped configuration sloping upwardly and outwardly to provide door hinge mounting surfaces. The frame members 10 are also of U-shaped cross sectional configuration, but one leg of the U-shaped configuration is vertically oriented and forms a support for the lower edge of the adjacent slope sheet, while the other leg slants upwardly and outwardly to form a door hinge mounting surface.

Figure 2:
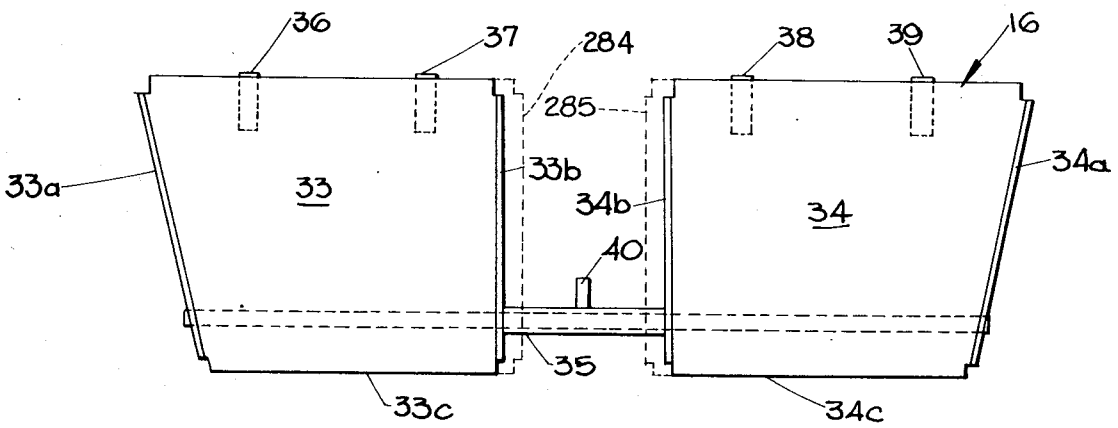
FIG. 2 is a simplified elevational view of an exemplary hopper door for a hopper car such as the one illustrated in FIG. 1.

In FIG. 2 hopper door 16 is illustrated. All of the hopper doors 16–23 are substantially identical, and a description of hopper door 16 may be considered to be a description of all of the remaining hopper doors 17–23. The hopper door 16 comprises two closure panels 33 and 34 which constitute mirror images of each other and which are joined together by an elongated brace 35. As indicated above, this construction is necessary since the closure panels 33 and 34 lie to either side of center sill 8. The uppermost edges of closure panels 33 and 34 are provided with pairs of hinge members 36–37 and 38–39, respectively. The pairs of hinge members cooperate with pairs of hinge members mounted on transverse braces 10 at the bottom edge of slope sheet 5. The closure panels 33 and 34 may have additional bracing elements (not shown) affixed to their outside surfaces.

Closure panels 33 and 34 are provided on their outer edges with inturned lips 33*a* and 34*a*, respectively. The lips 33*a* and 34*a* cooperate with outer hopper sheets such as those shown at 26 and 27 in FIG. 1. The closure panels 33 and 34 are similarly provided on their inner edges with inturned lips 33*b* and 34*b*, respectively, intended to cooperate with inner hopper sheets, such as those shown at 24 and 25 in FIG. 1. The bottom edges of closure panels 33 and 34 are provided with lips 33*c* and 34*c* which form a seal with each other when the opposed hopper doors of a pair are in their closed positions. Finally, the transverse brace 35 supports an upstanding lug 40, the purpose of which will be apparent hereinafter.

Figure 3:
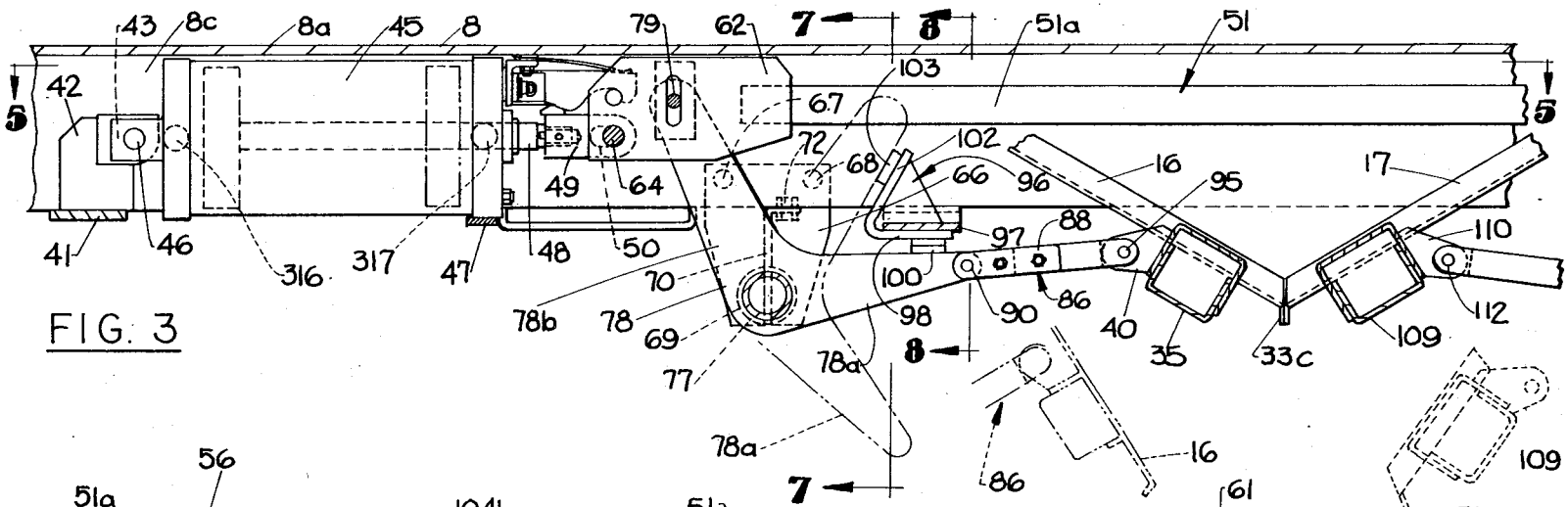
FIG. 3 is a fragmentary, cross sectional, side elevational view of the center sill, illustrating a portion of the door actuating and locking apparatus of the present invention, including the piston and air cylinder thereof.
Figure 4:
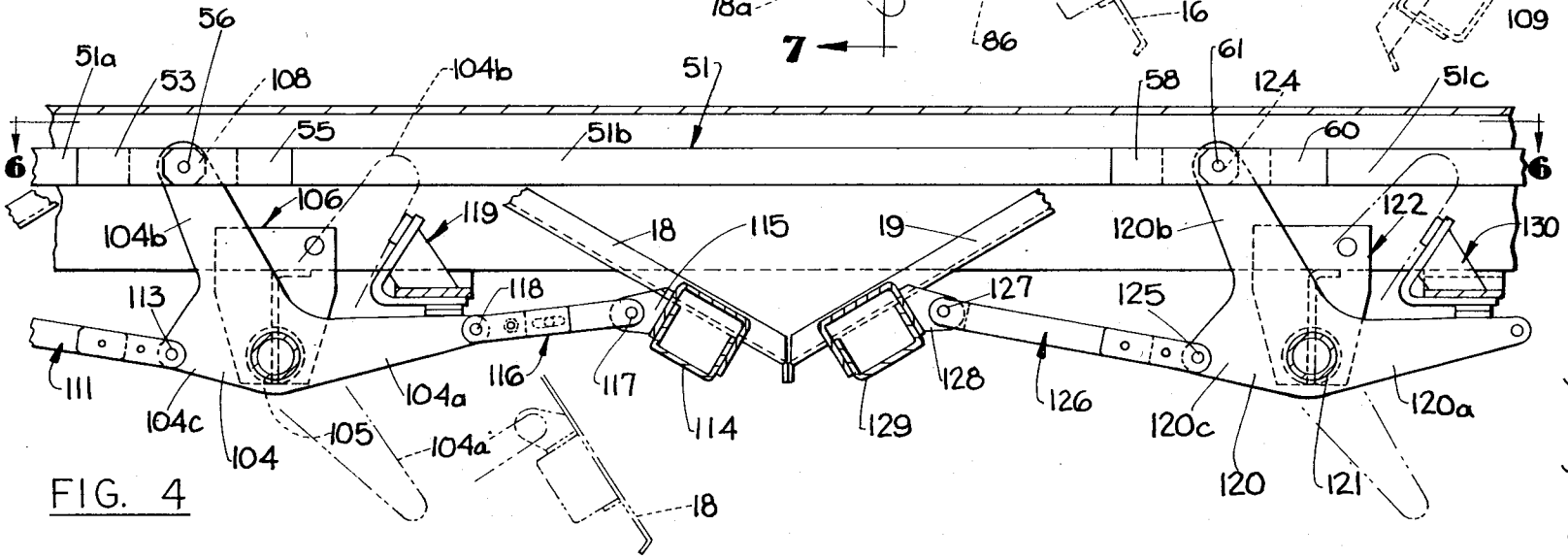
FIG. 4 is a fragmentary, cross sectional, side elevational view constituting a continuation of FIG. 3 and illustrating additional parts of the hopper door actuating and locking apparatus of the present invention.
Figure 5:
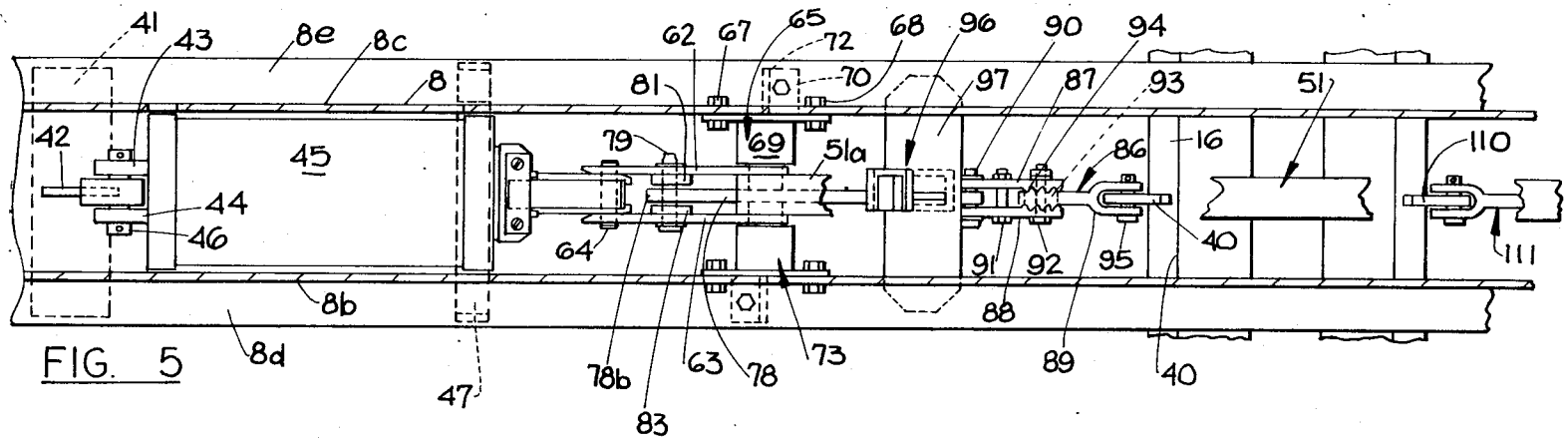
FIG. 5 is a fragmentary, cross sectional view taken along section 5—5 of FIG. 3.
Figure 6:
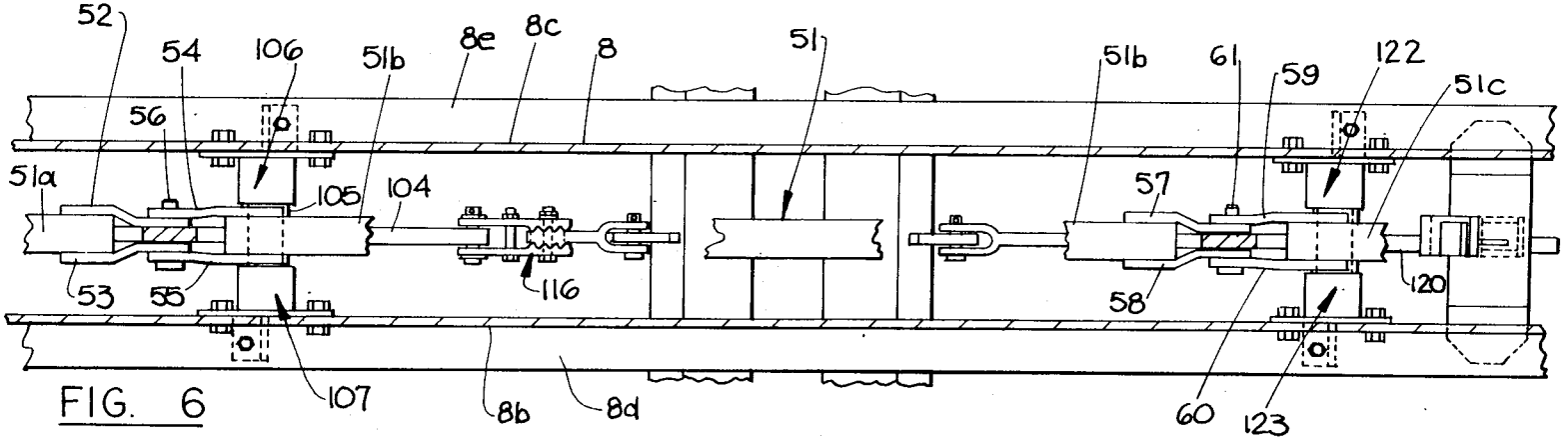
FIG. 6 is a fragmentary, cross sectional view taken along section line 6—6 of FIG. 4.
Figure 15:
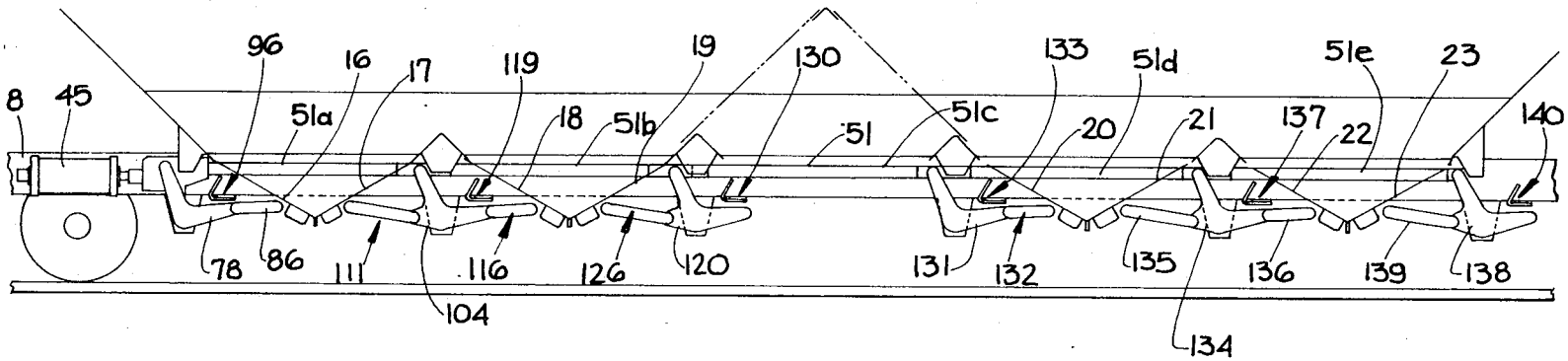
FIGS. 15–19 are fragmentary, semi-diagrammatic illustrations showing various hopper door arrangements to which the door actuating and locking apparatus of the present invention can be applied.

The hopper door actuating and locking apparatus of the present invention is best shown in FIGS. 3, 4, 5 and 6. FIG. 4 constitutes a continuation of FIG. 3 and these figures are a cross sectional elevational view of that much of the door actuating mechanism which operates hopper doors 16–17 and 18–19. FIG. 6 is a continuation of FIG. 5 and these figures are a cross sectional plan view of the structure of FIGS. 3 and 4. As will be apparent hereinafter, the apparatus of FIGS. 3–6 continues for the majority of the length of the center sill and identical lever apparatus is repeated to operate hopper doors 20–21 and 22–23 (see FIG. 15).

Figure 7:
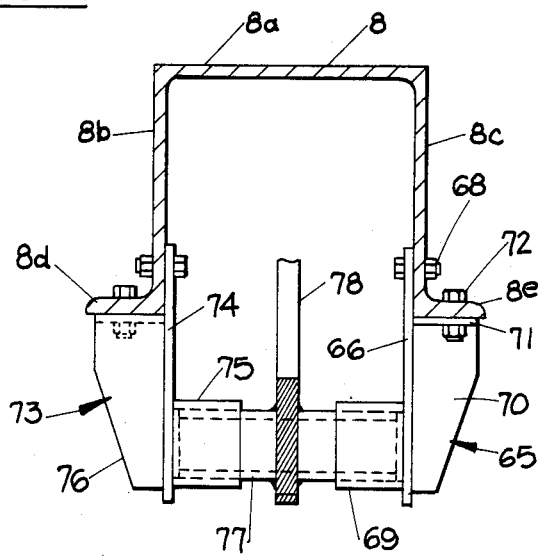
FIG. 7 is a cross sectional view taken along section line 7—7 of FIG. 3.
Figure 8:
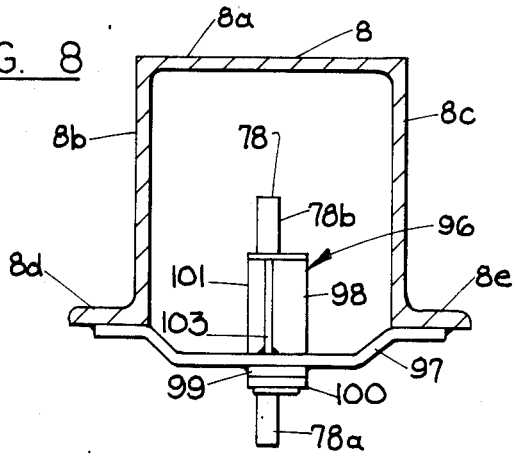
FIG. 8 is a cross sectional view taken along section line 8—8 of FIG. 3.

Before beginning the description of the apparatus of FIGS. 3–6, reference is briefly made to FIGS. 7 and 8 which most clearly show the cross sectional configuration of center sill 8. The center sill is of inverted U-shaped or hat shaped cross section having a horizontal base or web portion 8*a* which terminates in downwardly depending leg or side portions 8*b* and 8*c*, each terminating in outwardly extending lateral flange portions 8*d* and 8*e*, respectively.

Returning to FIGS. 3–6, a strap-like member 41 is welded or otherwise appropriately affixed to the center sill flanges 8*d* and 8*e*, extending transversely thereof. The strap-like member 41 supports an upstanding lug assembly 42 which is received between a pair of lugs 43 and 44 affixed to the rearward end of an air cylinder 45. The lug assembly 42 and cylinder lugs 43 and 44 are provided with coaxial perforations through which a pin 46 extends. In this fashion, the air cylinder 45 is pivotally mounted within the center sill 8.

A second strap-like member 47 extends transversely of the center sill flanges 8*d* and 8*e* and is appropriately affixed thereto. The strap-like element 47 serves as a support for the forward end of air cylinder 45. Thus, air cylinder 45 is capable of slight pivotal movement between the strap-like element 47 and the horizontal base or web 8*a* of center sill 8.

Figure 11:
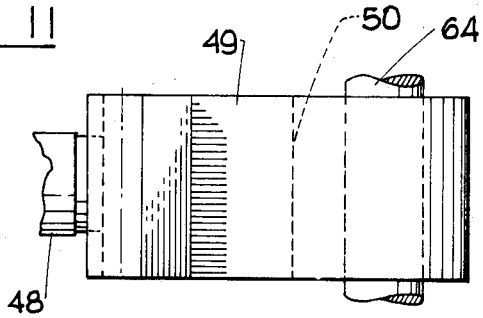
FIG. 11 is a fragmentary plan view of the fitting mounted on the end of the cylinder piston rod and provided with the latch cam.

The air cylinder 45 is provided with a piston rod 48, the free end of which carries a fitting 49. The fitting 49 may be threadedly engaged on the free end of piston rod 48, or otherwise affixed thereto. At its forward end, the fitting 49 has an elongated transverse slot 50 formed therein (see also FIGS. 10 and 11).

An actuating beam is generally shown at 51. The actuating beam is made up of a plurality of segments. In FIGS. 3–6, three such segments are shown at 51*a*, 51*b* and 51*c*. In the particular embodiment of hopper car shown in FIG. 1, there would be five such segments, extending for the majority of the length of center sill 8 (see FIG. 15). There will be a separate actuating beam segment between each adjacent pair of door levers, which will be apparent hereinafter. As is most clearly shown in FIG. 6, actuating beam segment 51*a* terminates at its right end (as viewed in that figure) in a pair of arms 52 and 53, welded or otherwise affixed thereto. The adjacent end of actuating beam segment 51*b* terminates in a pair of arms 54 and 55. The adjacent arms of segments 51*a* and 51*b* interdigitate and are provided with coaxial perforations, for the receipt of a pivot pin 56. In a similar fashion, the opposite end of actuating beam segment 51*b* terminates in arms 57 and 58 which cooperate with arms 59 and 60 of actuating beam segment 51*c* and are pivotally joined together by a pivot pin 61. The same sort of attachment is provided for all of the actuating beam segments whereby they are pivoted together in series. The actuating beam segments can be made of any appropriate material. In a preferred embodiment, they are formed of metal tubing having a rectangular cross section.

That end of beam segment 51*a* nearest air cylinder 45 has a pair of metallic plates 62 and 63 affixed thereto. The metallic plates are in parallel spaced relationship. A pin 64 passes through coaxial perforations in the free ends of plates 62 and 63 and through the elongated slot 50 in piston rod fitting 49 (see also FIGS. 10 and 11). In this way, longitudinal shifting of piston rod 48 will result in shifting of actuating beam 51, longitudinally of center sill 8. It will be noted that air cylinder 45, fitting 49, plates 62 and 63, together with actuating beam 51, are all located within center sill 8 and are therefore protected thereby.

Reference is now made to FIGS. 3, 5 and 7. In these figures, a bracket (generally indicated at 65) depends dowwardly from the leg or side portion 8*c*of center sill 8 and its adjacent flange 8*e*. The bracket 65 comprises a plate bolted to the inside surface of center sill leg or side portion 8*c* by bolts 67 and 68. The plate 66 depends downwardly from center sill 8 and has a short cylindrical element 69 welded or otherwise appropriately affixed to its inside surface, near its lower end. On its outside surface, a laterally extending, reinforcing plate 70 is welded to the plate 66. The plate 70 has a bent over portion 71 which underlies center sill flange portion 8*e* and is bolted thereto by bolt 72.

Directly opposite bracket 65 there is an identical bracket generally indicated at 73 comprising a downwardly depending plate 74, a cylindrical element 75 and a reinforcing plate 76. Brackets 65 and 73 could each constitute an integral one-piece casting, if desired.

A cylindrical shaft 77 is rotatively mounted in cylindrical bracket elements 69 and 75. The shaft 76 has welded thereto a lever 78.

Lever 78, as can most clearly be seen in FIG. 3, has a first arm 78*a* extending toward hopper door 16 and an upstanding lever arm 78*b*. The free end of upstanding arm 78*b* is pivotally attached to and between plates 62 and 63 by a transverse pivot pin 79. As can most clearly be seen in FIG. 10, the plate 62 has a vertical slot 80 formed therein. A reinforcing plate 81 is welded or otherwise affixed to the plate 62 and has a corresponding elongated slot 82 formed therein. The plate 63 has a similar coextensive elongated slot (not shown) therein and a reinforcing member 83 (see FIG. 5) identical to reinforcing member 81 of plate 62. As a result of this pivotal attachment of the upstanding lever arm 78*b* to and between plates 62 and 63, air cylinder 45 and its piston rod 48 can shift lever 78 between its door closed position shown in solid lines in FIG. 3 and its door open position shown in broken lines in FIG. 3. The arc defined by pivot pin 79 during this shifting is accommodated by the elongated vertical slots in plates 62 and 63.

The lever 78 and its shaft 77 pivot within bracket cylindrical elements 69 and 75.

Figure 12:
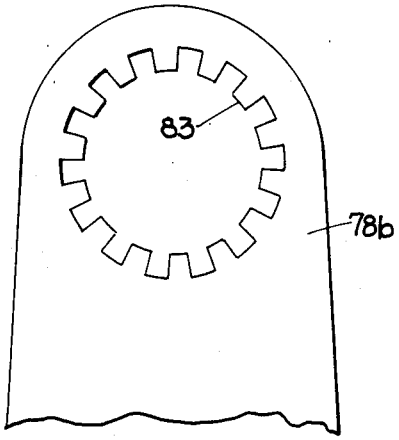
FIG. 12 is a fragmentary elevational view of the upper end of the upstanding arm of a typical lever of the present invention.
Figure 14:
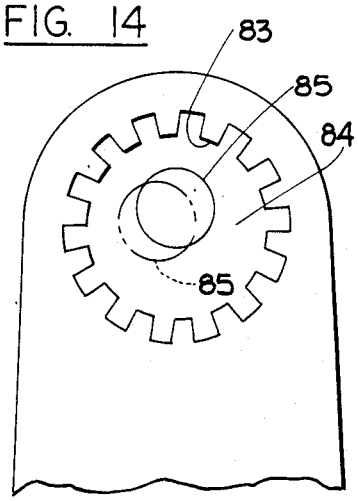
FIG. 14 is fragmentary elevational view illustrating the combination of the upper lever arm of FIG. 13 and the adjustment fitting of FIG. 14.

Reference is next made to FIG. 12. FIG. 12 fragmentarily illustrates the free end of upstanding lever arm 78*b*. The end of the arm 78*b* is provided with a toothed perforation 83. The toothed perforation 83 is adapted to receive a toothed adjustment fitting 84, illustrated in FIG. 14. The adjustment fitting 84 carries an off-center perforation 85 for receipt of pivot pin 79. As is shown in FIG. 14, the rotative position of adjustment fitting 84 in the perforation 83 of lever arm 78*b* will determine the position of pivot pin perforation 85. The perforation 85 is shown in one position in solid lines, and in another position in broken lines. This arrangement of parts enables fine adjustment of the door actuating and locking apparatus of the present invention to assure that the doors open and close properly. It will be understood that the adjustment fitting could be a multi-sided regular member, perforation 83 having a corresponding shape.

The free end of the arm 78*a* of lever 78 is connected to door 16 by a link assembly, generally indicated at 86. The link assembly 86 is best seen in FIGS. 3 and 4. The link assembly 86 comprises a pair of plates 87 and 88 and a link element 89. The plates 87 and 88 at one end are provided with coaxial perforations. The free end of link arm 78*a* is similarly perforated. A bolt or pivot pin 90 passes through the plate perforations and the perforation in lever arm 78*a* such that the plates are pivoted to the free end of the lever arm. The plates, themselves, are held together by additional bolts 91 and 92. The bolt 92 passes through a pair of coaxial perforations in plates 87 and 88 and an elongated slot 93 in the shank portion of link element 89. The end of the shank element located between plates 87 and 88 and the corresponding inside surfaces of plates 87 and 88 are serrated, as at 94. The cooperating serrated surfaces of link element 89 and plates 87 and 88, together with the slot 93 in the link shank of element 89, enable an overall length adjustment of the link assembly 86. This further enables fine adjustment of the assembly to assure that door 16 opens and closes properly. The free end of link element 89 is biforcated and a bolt or pivot pin 95 passes through coaxial perforations in the biforcations and a perforation in the lug 40 of door 16 so that the link assembly 86 is pivotally attached to the door 16.

The door actuating and locking mechanism for hopper door 16 is essentially completed by the provision of a stop member, generally indicated at 96. The stop 96 is best shown in FIGS. 3, 5 and 8. The stop 96 comprises a strap-like member 97 which extends transversely of center sill 8, with its ends welded or otherwise appropriately affixed to the underside of center sill lateral flanges 8*d* and 8*e*. The center portion of strap-like member 97 is slightly depressed, as is shown in FIG. 8.

An angle member 98 has a lower leg 99 welded, or otherwise appropriately attached to the underside of strap 97, at approximately the center thereof. Shim elements 100 may be welded or otherwise affixed to the leg 97 to assure proper adjustment of the stop. It will be noted that the shim elements 100 are contacted by the leg 78*a* of lever 78 when in its door-closed position. The angle member 98 has an upstanding leg 101 which may be provided with shim elements 102 (see FIGS. 3 and 5), to assure proper engagement of the stop assembly by the upstanding arm 78*b* of lever 78 when the door 16 is in its door-open position. This is shown in broken lines in FIG. 3. The stop is completed by a brace member 103 welded to the inside surface of angle member leg 102 and the upper surface of strap 97, to give the angle member additional strength.

In FIG. 3, the hopper door 16 is shown in its closed position. It will be noted that when in the closed position, the pivot point 90 between lever arm 78*a* and link assembly 86 lies slightly above an imaginary line drawn through the axis of shaft 77 and the pivot point 95 between link assembly 86 and the lug 40 of door 16. Thus, the assembly is in an over-center position when door 16 is closed, tending to lock the door in its closed position. The amount by which the assembly lies over-center is determined by the abutment of lever arm 78*a* against stop assembly 96. If the over-center position of the elements was too great, it will be understood that the door 16 would tend to shift again toward its open position. This is precluded by stop assembly 96.

To open door 16, it is only necessary to shift air cylinder piston rod 48 and actuating beam 51 sufficiently to rotate lever 78 through center. Once pivot point 90 between lever arm 78*a* and link assembly 86 shifts beneath the imaginary line passing through the axial center of shaft 77 and pivot point 95 between link assembly 86 and lug 40 of door 16, the door 16 will fall to its open position (pulling the piston of cylinder 45 with it) by virtue of its own weight if the hopper car is empty, or by virtue of its own weight and the weight of the load bearing thereon, if the hopper car is loaded. If, when the hopper car 1 is empty, the weight of the hopper 16 is insufficient to cause it to fall to its open position, or if for any other reason the door will not fall to its open position (car loaded or unloaded), the actuating mechanism will shove the door to its open position. When door 16 falls to its open position and its velocity exceeds that of the piston of cylinder 45, the piston and cylinder 45 will provide a cushioning effect, as will be described more fully hereinafter. The openmost position of door 16 is determined by the abutment of link arm 78*b* against stop assembly 86. The parts are so configured that the door lip 33*c* will not hit the rails upon which the hopper car rests.

To close door 16, the movement of air cylinder piston rod 48 and beam 51 is reversed, rotating lever 78 in a counter-clockwise direction as viewed in FIG. 3, until hopper door 16 achieves its over-center door-closed position, determined by the interaction of lever arm 78*a* and stop assembly 86.

Hopper doors 17 and 18 are controlled by a lever 104. The lever 104 is affixed to a transversely extending shaft 105 mounted in brackets 106 and 107. The brackets 106 and 107 are identical to each other and are identical to previously described brackets 65 and 73.

With one exception, the lever 104 is identical to the lever 78, having an arm 104*a* extending toward door 18 and an upstanding arm 104*b*. The lever 104 differs from lever 78 only in that it is provided with a third short arm 104*c* extending toward hopper door 17. It will be understood that lever 78 could have been identical to lever 104, its third arm simply being unused.

Figure 13:
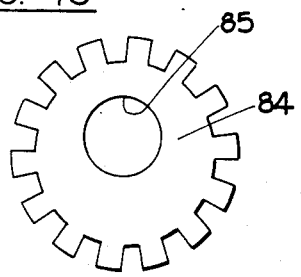
FIG. 13 is an elevational view of a splined adjustment fitting for use with the lever arm of FIG. 12.

The upstanding arm 104*b* is provided with an adjustment fitting 108 identical to the adjustment fitting 84 of FIG. 13. The pivot pin 56 joining actuating beam segments 51*a* and 51*b*, also passes through the perforation in adjustment fitting 108.

The door 17 is provided with a transverse brace 109, equivalent to brace 35 of door 16. The brace 109 carries a lug 110, equivalent to lug 40 of door 16. A link assembly 111 is provided. The link assembly is pivoted to the lug 110 of door 17 by pivot pin 112. The other end of link assembly 111 is pivoted by pivot pin 113 to lever arm 104*c*. In a similar fashion, the hopper door 18 is provided with a transverse brace 114 equivalent to the brace 35 of door 16. The brace 114 carries a lug 115 similar to lug 40 of door 16. A link assembly 116 is provided. One end of the link assembly is affixed to the lug 115 of door 18 by pivot pin 117. The other end of link assembly 116 is pivotally connected to the free end of lever arm 104*a* by pivot pin 118. The link assembly 116 is identical to link assembly 86 and is adjustable in length. The link assembly 111 is identical to link assemblies 86 and 116, the only exception being that it is slightly longer than the link assemblies 86 and 116. Finally, a stop assembly 119 is provided for lever 104. The stop assembly 119 is identical to the previously described stop assembly 96, and serves the same purpose.

The operation of lever 104 and hopper doors 17 and 18 is similar to that described with respect to lever 78 and hopper door 16. To this end, when lever 104 and hopper doors 17 and 18 are in their closed positions as illustrated in FIG. 4, the pivot point 113 between link assembly 111 and lever arm 104*c* lies in an over-center position just below the imaginary line drawn through pivot point 112 between link assembly 111 and the lug 110 of door 17 and the axial center of the shaft 105 of lever 104. Thus, door 17 and its linkage are in an over-center, locked position. Similarly, pivot point 118 between lever arm 104*a* and link assembly 116 lies just above and over-center with respect to an imaginary line drawn through the axial center of shaft 105 and the pivot point 117 between link assembly 116 and the lug 115 of hopper door 18. Thus, hopper door 18 and its linkage are in an over-center, locked position.

To shift hopper doors 17 and 18 to their open positions, it is only necessary for air cylinder piston rod 48 and actuating beam 51 to shift to the right (as viewed in FIG. 4) by an amount sufficient to cause pivot points 113 and 118 to pass through center. Once this is accomplished, the hopper doors 17 and 18 will fall to their open positions by virtue of their own weight (if heavy enough), when the car is empty, or by virtue of their own weight and the weight of the lading, if the car is full. As indicated above, the actuating mechanism will shove hopper doors 17 and 18 to the fully open position, if required. The actuating mechanism can also provide a cushioning effect, to be described. Again, the openmost position of hopper doors 17 and 18 will be determined by contact between lever arm 104*b* and stop assembly 119. This assures that the hopper door lips will not contact the rail upon which the car is resting.

To close hopper doors 17 and 18, air cylinder piston rod 48 and actuating beam 51 are shifted to the left as viewed in FIGS. 3 and 4, until the hopper doors 17 and 18 and their respective linkage regains their over-center, locked positions, determined by abutment of lever arm 104*a* against stop assembly 119.

Hopper door 19 is actuated by a lever 120. The lever 120 is identical to lever 104 and is provided with arms 120*a*, 120*b* and 120*c*. Lever 120 is affixed to shaft 121, equivalent to shaft 105 or shaft 77. The shaft 121 is mounted in bracket assemblies 122 and 123, identical to brackets 65 and 73 or brackets 106 and 107.

The upstanding arm 120*b* of lever 120 is provided with an adjustment fitting 124 identical to adjustment fitting 84 of FIG. 13. The arm 120*b* is connected to the actuating beam 51 by the pivot pin 61 which joins actuating beam segments 51*b* and 51*c*.

The arm 120*c* of lever 120 has pivotally connected to it at 125 a link assembly 126. Link assembly 126 is identical to link assembly 111. The other end of link assembly 126 is pivoted as at 127 to a lug 128 on a transverse brace 129 on hopper door 19.

The arm 120*a* of lever 120 is not connected to a hopper door. The purpose of lever arm 120*a* is to cooperate with a stop assembly 130. Stop assembly 130 is identical to stop assemblies 96 and 119, and seres the same purpose.

Hopper door 19 and its actuating and locking mechanism operate in the same manner as hopper door 17. In FIG. 4, door 19 is shown in its door-closed position. In this position, the pivot point 125 between link assembly 126 and lever arm 120*c* is located in an over-center position just below the imaginary line drawn through the axial center of lever shaft 121 and the pivot point 127 between link assembly 126 and the lug 128 of hopper door 19. Thus, hopper door 19 is locked in its closed position. The over-center position of pivot point 125 is determined by abutment of lever arm 120*a* and stop assembly 130. To open hopper door 19, it is only necessary to shift piston rod 48 and actuating beam 51 to the right (as viewed in FIGS. 3 and 4) by an amount sufficient to cause pivot point 125 to pass through center. Thereafter, hopper door 19 will open under its own weight (if heavy enough), or under its own weight together with the weight of the lading, if the car is loaded. Again, the actuating mechanism can shove hopper door 19 to its fully open position, if required, and may provide a cushioning effect, if desired. The lowermost position of hopper door 19 is determined by abutment of lever arm 120*b* against stop assembly 130. Again, this is so arranged that the lip of hopper door 119 will not contact the rail upon which the car is mounted. To close hopper door 19, air cylinder piston rod 48 and actuating beam 51 must be shifted to the left (as viewed in FIGS. 3 and 4), until pivot point 125 between link assembly 126 and lever arm 120*c* achieves its over-center, locked position, as determined by stop assembly 130.

With reference to FIGS. 1, 3, 4 and 15, it will be understood that hopper door 20 will be provided with a lever 131 identical to lever 78 and a link assembly 132 identical to link assembly 86. Similarly, hopper doors 21 and 22 will be provided with a lever 134 identical to lever 104, provided with link assemblies 135 and 136 identical to link assemblies 111 and 116. Finally, hopper door 23 will be provided with a lever 138 identical to lever 120 and a link assembly 139 identical to link assembly 126. The additional three levers required for hopper doors 20–23 will be pivotally connected to actuating beam 51 at the junctures of beam segments 51*c*, 51*d* and 51*e*. Levers 131, 134 and 138 will each have a stop assembly (133, 137 and 140, respectively) identical to stop assembly 96. The operation of hopper doors 20 through 23 will be identical to that described with respect to hopper doors 16–19.

The door actuating and locking apparatus just described represents an improvement over that taught in U.S. Pat. Nos. 3,187,684 and 3,596,609. First of all, it will be noted that the door actuating and locking apparatus of the present invention is simpler and involves fewer parts. Secondly, much of the door actuating and locking apparatus is located within center sill 8, and is protected thereby. In addition, those parts of the actuating mechanism below the outer sill are located above the closed door profile for additional protection.

In the door actuating systems taught in the above identified patents, the hopper doors are opened sequentially. This means that a major portion of the work is accomplished at the end of the cylinder thrust. In the door actuating and locking apparatus of the present invention, the hopper doors are shifted through center at the beginning of the stroke of air cylinder piston rod 48, i.e. at the peak of air pressure. Once the doors pass through center, they will fall to their open positions by virtue of their own weight (if heavy enough), or they will fall to their open position under their own weight and the weight of the lading within the car. As a result, the doors tend to drag the piston rod 48 and its piston within air cylinder 45, and the air cylinder thus acts as a cushion for the hopper doors during the door opening operation.

A smaller diameter piston can be used since less cylinder stroke is required (and thus less air under pressure is needed). The levers and link assemblies of the door actuating and locking apparatus of the present invention are characterized by greater mechanical advantage than prior art actuating systems utilizing segmented beams, having longer lever arms and more positive over-center door-closed positions. The parts are readily accessible and capable of fine adjustments. It will be understood that the door actuating and locking apparatus of the present invention also closes the doors simultaneously.

It is preferred that an automatic latch means be provided for actuating beam 51 to automatically lock the actuating beam in door-closed position under all dynamic conditions of the hopper car, until purposefully released. Such latch means are not new, per se. An exemplary latch means, for example, is taught in U.S. Pat. No. 4,132,177. The actuating beam latch of the present invention constitutes an improvement in the art, being positive in action, simple in construction, and requiring fewer parts.

Reference is made to FIGS. 3, 5, 9 and 10. The latch mechanism comprises a latch structure mounted on the front face of air cylinder 45 above cylinder piston rod 48 and fitting 49. As is most clearly shown in FIGS. 9 and 10, the latch structure comprises one or more shim plates (one being shown at 141). Adjacent shim plate 141 there is an angle member 142 having an upper horizontal leg **142*a* and a downwardly depending leg 142*b*. Adjacent angle member 142 there are a pair of angle members 143 and 144. The angle member 143 has a leg portion 143*a* abutting the downwardly depending leg 142*b* of angle member 142, and a forwardly extending leg 143*b*. Similarly, angle member 144 has a leg 144*a* abutting the downwardly depending leg 142*b* of angle member 142 and a forwardly extending leg 144*b*. The assembly thus far described is affixed to the forward face of air cylinder 45 by a pair of bolts 145 and 146. This assembly could constitute an integral, one-piece, cast part of the forward face of cylinder 45**.

It will be noted that the legs **143*b* of angle member 143 and 144*b* of angle member 144 lie in parallel spaced relationship. Between these legs there is located the shank of a latch member 147. The angle member legs 143*b* and 144*b*, together with the shank of latch member 147 are provided with coaxial perforations through which a pivot pin 148 extends. In this fashion, the latch member 148 is pivotally affixed to the forward face of air cylinder 45**.

Figure 9:
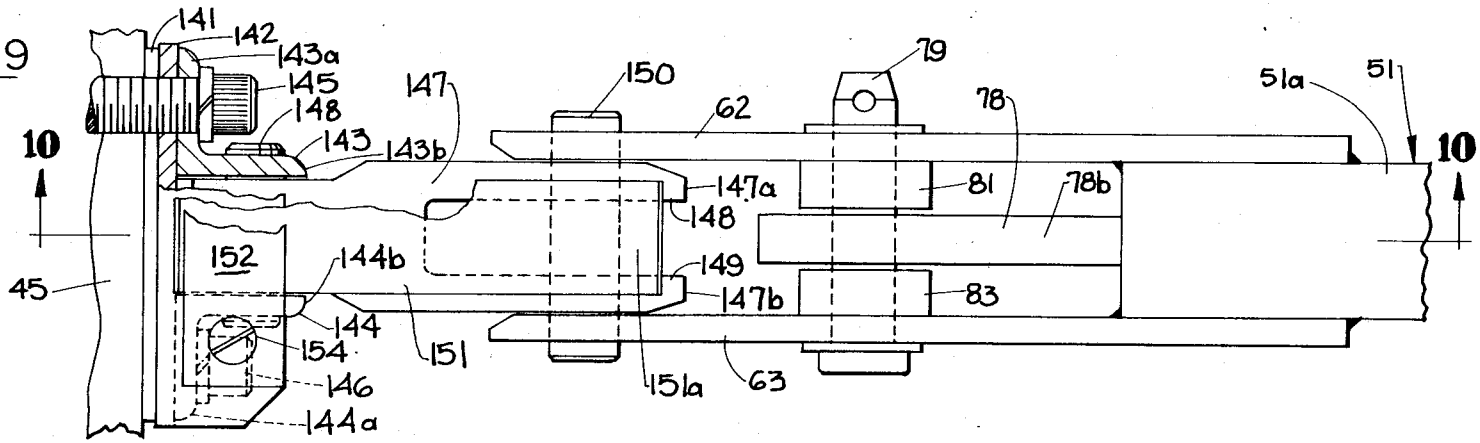
FIG. 9 is a fragmentary plan view, partly in cross section, illustrating the latch of the present invention.
Figure 10:
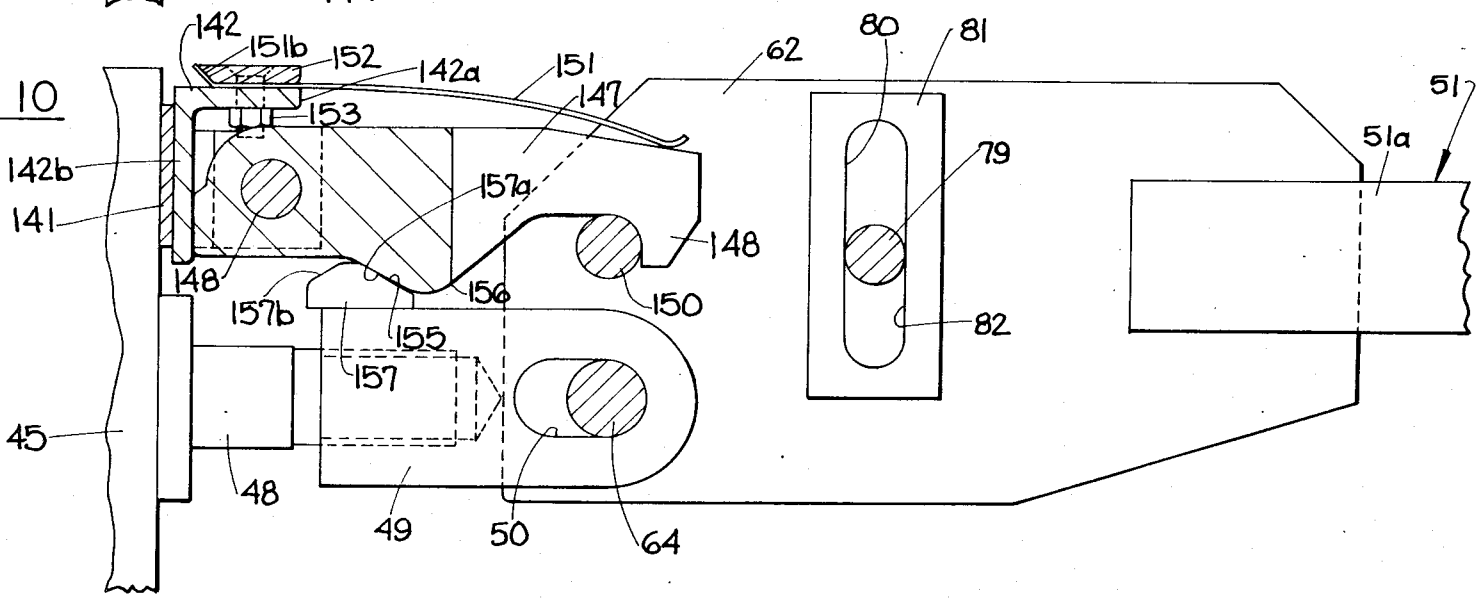
FIG. 10 is a cross sectional elevational view taken along section line 10—10 of FIG. 9.

As will be evident from FIGS. 9 and 10, the forward end of latch member 147 is bifurcated, and the forward ends of bifurcations **147*a* and 147*b* terminate in hook-like portions 148 and 149**.

The plates 62 and 63 attached to the first segment **51*a* of actuating beam 51 are provided with a pair of coaxial perforations for receipt of a latch pin 150. The latch pin 150 is located directly above pin 64 in fitting 49, as is most clearly shown in FIG. 10. The latch pin 150 is adapted to be engaged by the hook-like portions 148 and 149 of latch member 147**.

In FIGS. 9 and 10, the actuating beam 51 and cylinder piston rod 48 are shown in their nearly fully-retracted, locked position, i.e. the position they would occupy when the hopper doors 16–23 are in their fully closed positions. The latch member 147 is biased to its locking position (engaging latch pin 150, as shown) by a resilient leaf spring 151. The forward end **151*a* of leaf spring 151 is adapted to contact the upper surface of the forward ends of bifurcations 147*a* and 147*b* of latch member 147. The rearward end 151*b* of leaf spring 151 is mounted on the upper surface of leg 142*a* of angle member 142 and is captively held in place by a keeper plate 152. The keeper plate 152 is affixed to the leg 142*a* of angle member 142 by a pair of bolts 153 and 154**.

As is most clearly shown in FIG. 10, latch member 147 has a downwardly depending bulge, providing cam surfaces 155 and 156. A cam element 157 is mounted on fitting 49 and provides cam surfaces **157*a* and 157*b***.

The latch assembly of the present invention having been described, the manner of its operation will now be set forth. Again it is noted that in FIGS. 9 and 10 the latch assembly is shown in its latched position, maintaining actuating beam 51 in its retracted, door-closed position. Piston rod 48 and its fitting 49 are also shown in their nearly fully retracted position. It will be noted that the cam surface **157*a* of cam element 157 is adjacent the cam surface 155 of latch member 147**.

When it is desired to shift the hopper doors 16–23 to their open positions, air cylinder 45 is actuated and piston rod 48 and its fitting 49 begin to shift to the right, as viewed in FIGS. 9 and 10. Cam surface **157*a* of cam element 157 cooperates with cam surface 155 of latch member 47 to lift the latch member against the action of leaf spring 151 and out of engagement with latch pin 150. At the point where latch member 147 releases latch pin 150, the pin 64 has traveled to the rearward end of slot 50 in fitting 49. Further movement of piston rod 48 will now cause movement of the unlatched actuating beam 51. During a door-closing operation, as the piston rod 48 and its fitting 49 shift to the left, as viewed in FIGS. 9 and 10, it will be apparent that the cam surface 156 of latch member 147 will first be contacted by the cam surface 157*b* of cam element 157. This will cause the latch to be lifted against the urging of leaf spring 151 to a position wherein latch pin 150 can slip beneath the hooked portions 148 and 149 of latch member 147. Ultimately, the latch member will achieve the position, relative to fitting 49, shown in FIGS. 9 and 10. The latch assembly of the present invention will assure that the actuating beam 51 and the hopper doors 16–23 will remain in the door-closed condition under all dynamic conditions of the hopper car, until purposely shifted to the door-open position by actuation of air cylinder 45**.

The door actuating and locking apparatus of the present invention is highly versatile, and may be used on many types of hopper cars having different arrangements of hopper doors. To illustrate this, reference is made to the diagrammatic illustrations of FIGS. 16–19.

Figure 16:
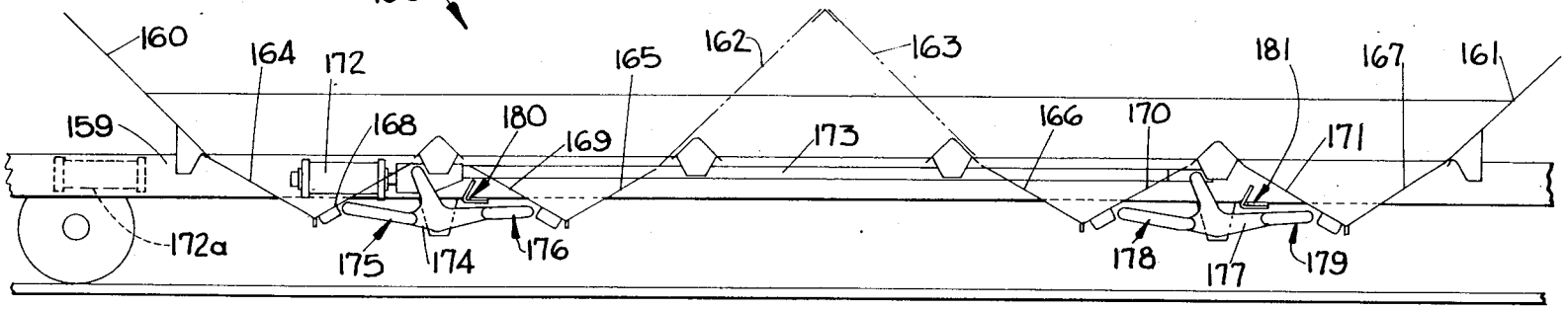

Referring first to FIG. 16, there is diagrammatically illustrated a hopper car generally indicated at 158 having an inverted U-shaped or hat shaped center sill 159, end slope sheets 160 and 161, and intermediate slope sheets 162 and 163. The hopper car 158 is provided with opposed pairs of chutes 164–165 and 166–167. The chutes 164–167 are provided with hopper doors 168–171. The hopper doors may be similar to hopper door 16 of FIG. 2.

In this embodiment, an air cylinder 172 is provided, operating an actuating beam 173. Air cylinder 172 can be located nearer the adjacent end of the hopper car 158, as shown in broken lines at 172*a*. Hopper doors 168 and 169 are actuated by a lever 174 connected to hopper door 168 by a link assembly 175 and connected to hopper door 169 by a link assembly 176. In similar fashion, the hopper doors 170 and 171 are actuated by a lever arm 177, connected to hopper door 170 by link assembly 178 and to hopper door 171 by link assembly 179. The levers 174 and 177 may be identical to levers 104 and 20 of FIG. 4. Link assemblies 175 and 178 may be identical to link assemblies 111 and 126, while link assemblies 176 and 179 may be identical to link assembly 86 of FIG. 3 and link assembly 116 of FIG. 4. Both levers 174 and 177 are provided with stop assemblies 180 and 181, respectively, which may be identical to stop assemblies 96, 119 and 130 of FIGS. 3 and 4. The operation of hopper doors 68–69 and 70–71 will be identical to that described with respect to hopper doors 17 and 18, with respect to FIGS. 3 and 4.

Figure 17:
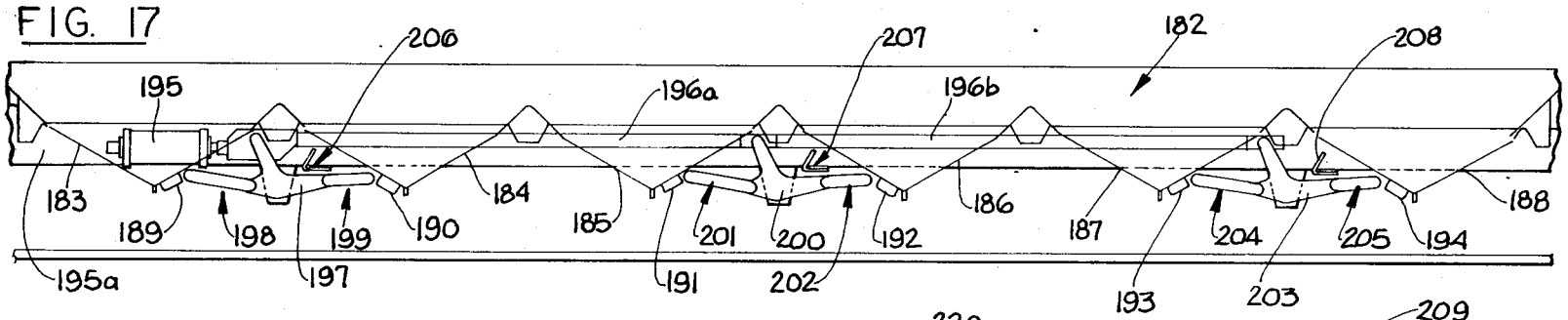

FIG. 17 diagrammatically illustrates a hopper car (generally indicated at 182) having six chutes 183–188. Each chute is closed by a hopper door 189–194, respectively. In this instance, the door actuating and locking mechanism comprises an air cylinder 195 and a two-segment actuating beam 196*a*–196*b* located within a center sill 195*a* of inverted U-shaped or hat shaped cross section.

Hopper doors 189 and 190 are actuated by a lever 197 and a pair of link assemblies 198 and 199. Similarly, hopper doors 191 and 192 are actuated by a lever 200 and a pair of link assemblies 201 and 202. Finally, hopper doors 193 and 194 are actuated by a lever 203 and a pair of link assemblies 204 and 205. Each of the levers 197, 200 and 203 have cooperating stop assemblies 206, 207 and 208, respectively. The stop assemblies 206–208 are identical to stop assemblies 96, 119 and 130 of FIGS. 3 and 4. The levers 197, 200 and 203 are identical to levers 104 and 120 of FIG. 4. Link assemblies 198, 201 and 204 are identical to link assemblies 111 and 126 shown in FIG. 4, while link assemblies 199, 202 and 205 are identical to link assemblies 86 and 116 of FIGS. 3 and 4. As a result of this, the operation of hopper doors 189–190, 191–192 and 193–194 are substantially identical to the operation described with respect to hopper door 17–18 of FIGS. 3 and 4.

Figure 18:
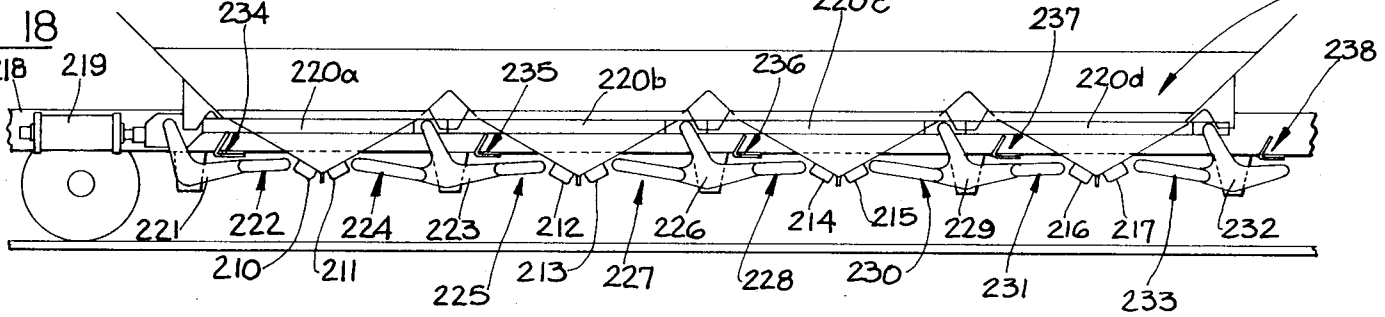

Yet another hopper car with a different arrangement of doors is shown diagrammatically in FIG. 18 and is generally indicated at 209. The hopper car 209 is provided with four sets of opposed, cooperating hopper doors 210–211, 212–213, 214–215 and 216–217.

The hopper car has a center sill 218 of inverted U-shaped or hat shaped cross section containing an air cylinder 219 and an actuating beam made up of four segments 220*a*, 220*b*, 220*c* and 220*d*.

Hopper door 210 is actuated by a lever 221 and a link assembly 222. Hopper doors 211 and 212 are actuated by a lever 223 and a pair of link assemblies 224 and 225. Hopper doors 213 and 214 are actuated by a lever 226 and a pair of link assemblies 227 and 228. In similar fashion, hopper doors 215 and 216 are actuated by a lever 229 and a pair of link assemblies 230 and 231. Finally, hopper door 217 is actuated by lever 232 and a link assembly 233. Each of the levers 221, 223, 226, 229 and 232 are provided with stop assemblies 234–238, respectively. All of the stop assemblies 234–238 can be identical to stop assembly 99 of FIG. 3 and stop assemblies 119 and 130 of FIG. 4. Lever 221 is identical to lever 78 of FIG. 3. The remaining levers 223, 226, 229 and 232 are identical to levers 104 and 120 of FIG. 4. All of link assemblies 222, 225, 228 and 231 are identical to link assembly 86 of FIG. 3 and link assembly 116 of FIG. 4. All of the link assemblies 224, 227, 230 and 233 are identical to link assemblies 111 and 126 of FIG. 4.

The actuation of hopper door 210 is identical to that described with respect to hopper door 16 of FIG. 3. The actuation of hopper doors 211–212, 213–214 and 215–216 is identical to that described with respect to hopper door 17 of FIG. 3 and hopper door 18 of FIG. 4. Finally, actuation of hopper door 17 is identical to that described with respect to hopper door 19 of FIG. 4.

Figure 19:
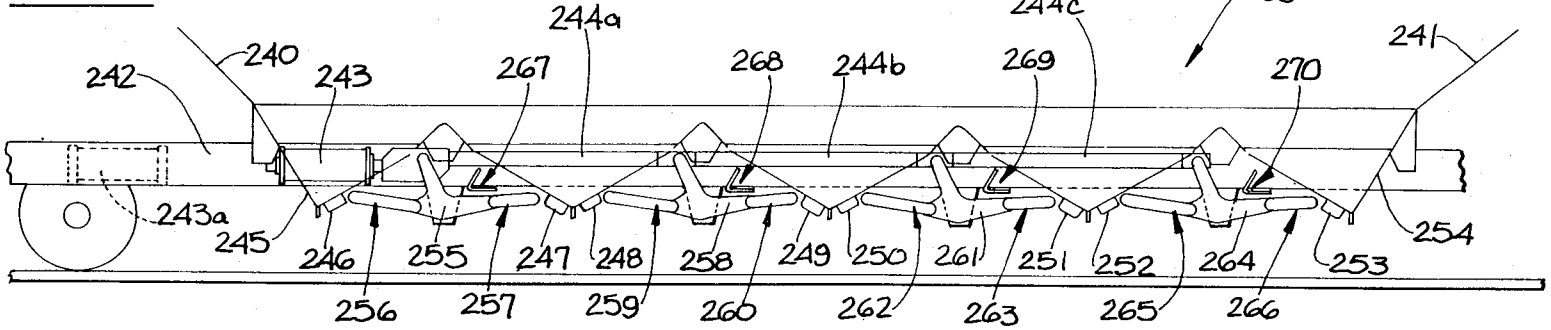

A final exemplary hopper door arrangement is illustrated in FIG. 19. In this diagrammatic figure, the hopper car is generally indicated at 239. The hopper car 239 has end slope sheets 240 and 241 and a center sill 242 of inverted U-shaped or hat shaped cross section. The center sill 242 contains a cylinder 243 and an actuating beam made up of three segments 244*a*, 244*b* and 244*c*.

Hopper car 239 of FIG. 19 is provided with an end chute 245 closed by a hopper door 246. The hopper car is then provided with three cooperating opposed sets of hopper doors 247–248, 249–250 and 251–252. A final hopper door 253 closes an end chute 254.

Hopper doors 246 and 247 are actuated by lever 255 and link assemblies 256 and 257. Precisely the same arrangement is provided for hopper doors 248–249, 250–251 and 252–253. All of levers 255, 258, 261 and 264 of FIG. 19 are identical to levers 104 and 120 of FIG. 4. All of link assemblies 256, 259, 262 and 265 of FIG. 19 are identical to link assemblies 111 and 126 of FIG. 4. Link assemblies 257, 260, 263 and 266 of FIG. 19 are identical to link assemblies 86 of FIG. 3 and 116 of FIG. 4. Actuation of the hopper doors of FIG. 19 is identical to that described with respect to hopper doors 17 and 18 of FIGS. 3 and 4. All of levers 255, 258, 263 and 266 are provided with stop assemblies 267, 268, 269 and 270, respectively. These last mentioned stop assemblies are identical to stop assemblies 96 of FIG. 3 and 119 and 130 of FIG. 4.

From the above, it will be apparent that the door actuating and locking apparatus of the present invention can be employed on hopper cars having numerous types of hopper door arrangements. In addition, the apparatus of the present invention can be retrofitted to existing hopper cars.

Returning to FIG. 2, it will be remembered that the panels 33 and 34 of hopper door 16 are each provided with downwardly depending lips 33*c* and 34*c*, which are adapted to form a seal with corresponding lips on a cooperating hopper door or on a chute, depending upon the hopper door arrangement of a given hopper car.

Various lip configurations forming seals between adjacent cooperating hopper doors are taught in the above noted U.S. Pat. No. 3,596,609.

Figure 20:
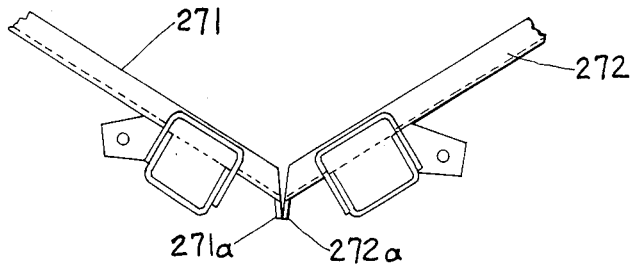
FIGS. 20 and 21 are fragmentary, diagrammatic representations of a pair of opposed hopper doors, illustrating the manner in which the door lips form a seal when the doors are in closed position.
Figure 21:
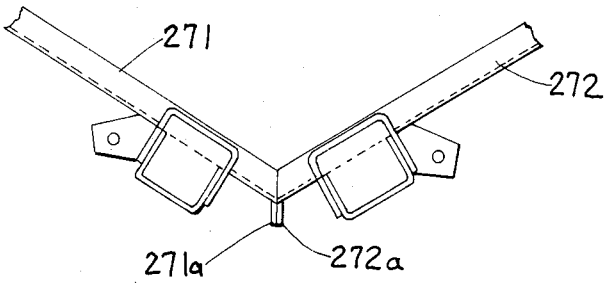

Reference is now made to FIGS. 20 and 21. In these figures adjacent closure panels of a cooperating pair of hopper doors are shown at 271 and 272. The cooperating panels are provided with lips 271*a* and 272*a*, respectively, along their bottom edges. FIG. 20 illustratesd panels 271 and 272 at the point of initial contact during a hopper door closing procedure. It will be noted that the panel lips 271*a* and 272*a* first contact each other, defining a narrow V-shape therebetween. When the hopper doors achieve their final, over-center, fully closed positions, the lips 271*a* and 272*a* are pressed together into substantial parallelism, forming a seal therebetween through which the lading cannot pass.

Figure 22:
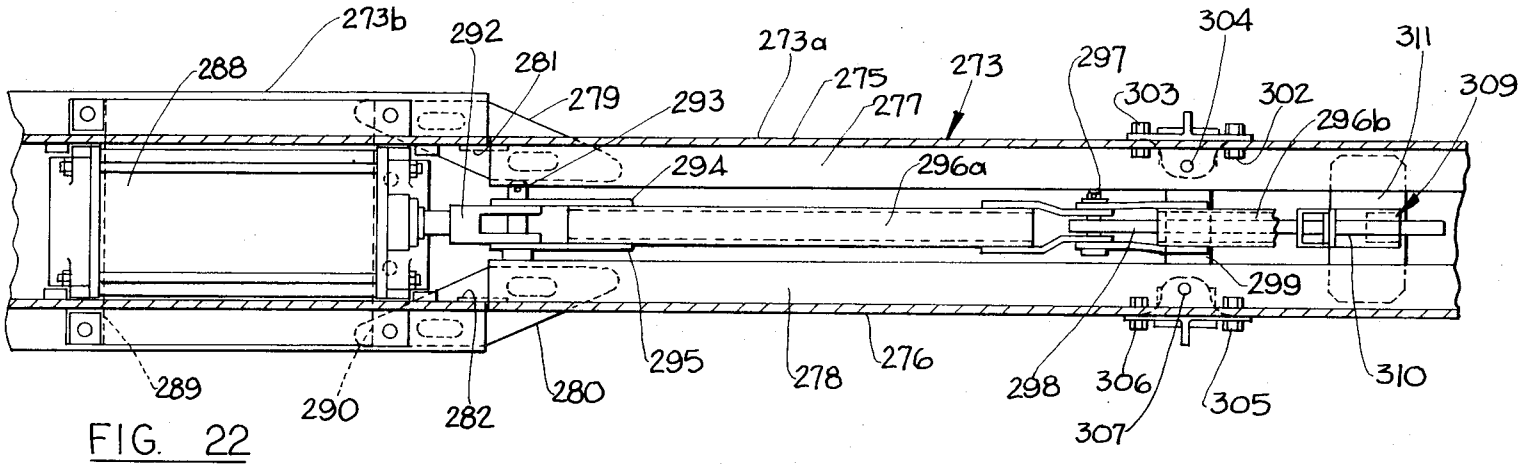
FIG. 22 is a fragmentary, cross sectional view, similar to FIG. 5 and illustrating another embodiment of the present invention.
Figure 23:
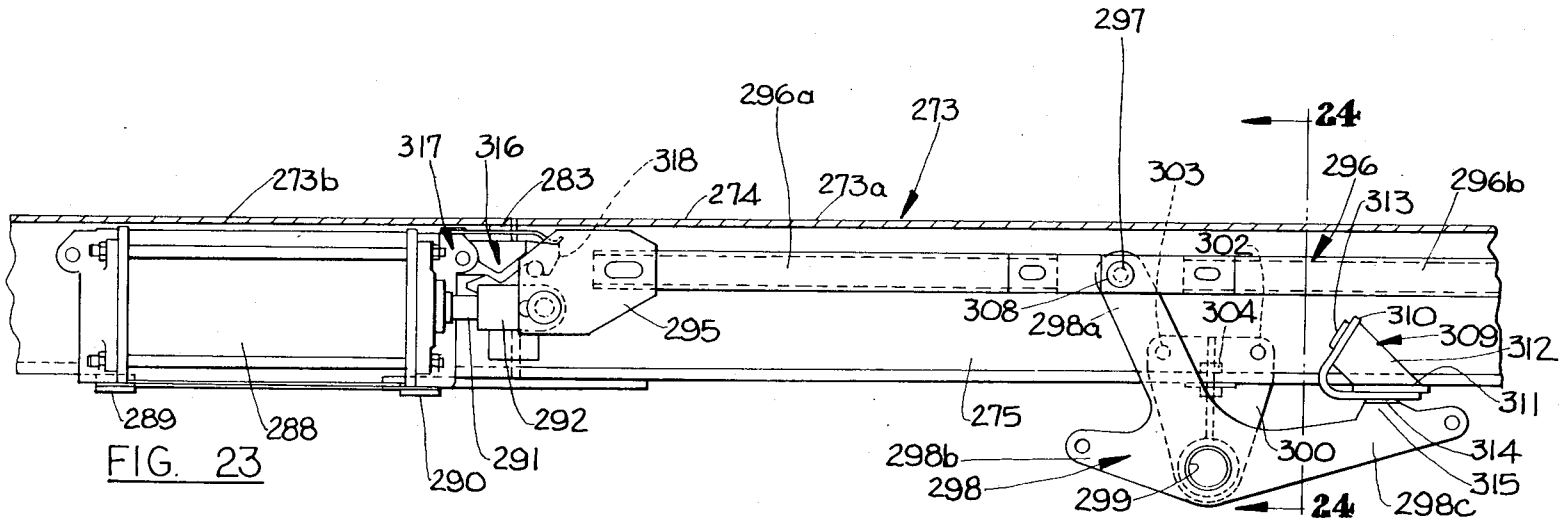
FIG. 23 is a fragmentary, cross sectional, side elevational view of the structure of FIG. 22.
Figure 24:
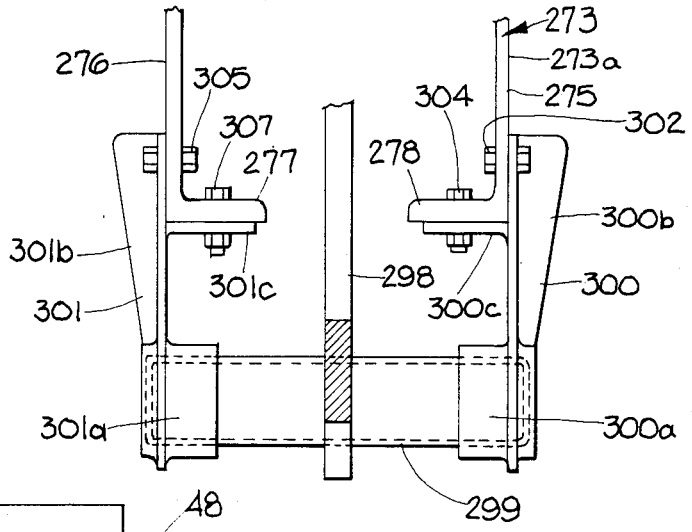
FIG. 24 is a cross sectional view taken along section line 24—24 of FIG. 23.

Reference is now made to FIGS. 22 through 24, wherein another embodiment of the present invention is illustrated. In this embodiment, the center sill is generally indicated at 273. The center sill 273 is made up of a central portion 273*a* and end portions, one of which is shown at 273*b*. The central portion 273*a* of center sill 273 constitutes the majority of the center sill and is of inverted U-shape having an upper portion 274, with downwardly depending legs 275 and 276. The primary difference between the embodiment of FIGS. 22 through 24 and the previously described embodiment lies in the fact that the downwardly depending legs 275 and 276 of the center portion 273*a* of the center sill terminate in inturned flanges 277 and 278, respectively. The end portion 273*b* is of hat-shaped cross sectional configuration, as is true of the entire center sill 8 of the previously described embodiment. It will be understood that the other end portion of center sill 273 (not shown) will similarly be of hat-shaped cross section. The end portion 273*b* of center sill 273 is attached to the adjacent end of center portion 273*a* by welding, using attachment plates 279 through 283. The other end (not shown) of center sill 275 will similarly be attached to center portion 273*a*.

The provision of center sill center portion 273 with its inturned flanges 277 and 278 has a number of advantages. For example, the inner hopper sheets such as those shown at 24 and 25 in FIG. 1 can be directly affixed (by any appropriate means) to the sides of downwardly depending center sill legs 275 and 276. In the absence of outwardly extending flanges such as 8*d* and 8*e* shown in FIGS. 7 and 8, the hopper door panel 33 and 34 of each hopper door can be enlarged, along their inside edges, as shown in broken lines at 284 and 285 in FIG. 2. This, of course, results in enlarged discharge openings.

In the embodiment of FIGS. 22 through 24 a fluid cylinder (preferably an air cylinder) 288 is provided, similar to air cylinder 45. In this instance, however, cylinder 288 is supported by straps 289 and 290 and is rigidly mounted within center sill end portion 273*b*, rather than being pivotally mounted as in the embodiment shown in FIG. 3. Cylinder 288 is provided with a piston-piston rod assembly 291. The free end of piston-piston rod assembly 291 is provided with a fitting 292, equivalent to fitting 49 of FIG. 3. The fitting 292 is connected by pin 293 to a pair of plates 294–295 equivalent to plates 62 and 63 of FIGS. 3 and 5.

An actuating beam is generally indicated at 296. The actuating beam 296 is segmented (as is actuating beam 51 of FIGS. 3 and 5). Two segments 296*a* and 296*b* are illustrated in FIGS. 22 and 23. Segments 296*a* and 296*b* are pivotted together by pivot pin 297, equivalent to pivot pin 56 of FIGS. 4 and 6.

For purposes of an exemplary showing, the embodiments of FIGS. 22 through 24 may be considered to be provided on a hopper car of the type illustrated in FIG. 19, with air cylinder 288 in the position of air cylinder 243*a* of FIG. 19. To this end, a lever 298 is shown in FIGS. 22–24 equivalent to lever 255 of FIG. 19. The lever 298 is non-rotatively affixed to a shaft 299. The shaft 299 is rotatively mounted in cylindrical portions 300*a* and 301*a* of brackets 300 and 301. The brackets 300 and 301 are equivalent to brackets 65 and 73 of FIG. 7. In this instance, however, the brackets 300 and 301 are illustrated as being cast members, rather than being fabricated of individual parts. The bracket 300 has a longitudinaly reinforcing flange portion 300*b* and an inturned flange portion 300*c*. Similarly, bracket 301 has a longitudinally extending reinforcing flange portion 301*b* and an inturned flange portion 301*c*. Unlike the embodiment of FIG. 7, the bracket 300 is affixed to the exterior of center sill leg 275 by a pair of bolts 302 and 303 (see FIG. 23). The bracket flange portion 300*c* underlies the inturned flange 278 of center sill leg 275 and is affixed thereto by a bolt 304. In a similar fashion, the bracket 301 is affixed to center sill leg 276 and its inturned flange 277 by bolts 305, 306 and 307.

Lever 298 has an upstanding arm 298*a* which is pivotally connected to actuating beam 296 by pivot pin 297. The upstanding arm 298 may have an adjustment means 308 equivalent to the adjustment means 84 described with respect to FIGS. 12 through 14. Lever 298 has a second arm 298*b* which will be connected to a door (not shown) equivalent to door 246 of FIG. 19 by a link assembly (not shown) equivalent to link assembly 256 of FIG. 19. Similarly, lever 298 has a third arm 298*c*. The third arm 298*c* will be connected to a door (not shown) equivalent to door 247 of FIG. 19 by a link assembly (not shown) equivalent to the link assembly 257 of FIG. 19.

The lever arm 298 is provided with a stop member 309 equivalent to stop member 267 of FIG. 19. In this instance, stop member 309 comprises an angle iron 310 affixed to the underside of a strap 311 which spans and is affixed to the inturned flanges 277 and 278 of center sill 273. Unlike the stop member 96 described with respect to FIG. 8, the plate 311 does not have a central depressed portion, as does plate 97 of FIG. 8. The angle iron 310 is reinforced by an additional plate 312 extending between the upper leg of the angle iron and the plate 311. The angle iron may additionally be provided with shim means 313 and 314 to assure that lever arms 298*a* and 298*c* are in their proper rotative positions when they abut the stop member 309. Since the plate 311 is planar in this embodiment, the lever arm 298*c* is provided with a small abutment extension 315, cooperating with stop member 309.

The door actuating assembly of FIGS. 22 and 23 may be provided with a latch assembly, generally indicated at 316. The latch assembly may be identical to that described with respect to FIG. 9 and 10. In this instance, FIG. 23 illustrates the structure (generally indicated at 317) which supports latch hook 318, as being an integral, one-piece part of the forward end of cylinder 288.

The operation of the embodiment of FIGS. 22 and 23 is identical to that of the previously described embodiment.

As indicated above with respect to the embodiment of FIGS. 3 and 5, the air cylinder 45 can provide a cushioning effect for the doors, during the door opening procedure. This is of course also true for the embodiment of FIGS. 22 through 24. Turning to FIG. 3, it will be noted that the air cylinder 45 is provided with orifices 316 and 317 at its ends. During the door opening and closing procedures, these orifices serve as both inlets and outlets. To gain the best advantage of the above noted cushioning effect, it may be desirable to regulate the exhaust during the door-opening procedure. Means for accomplishing this are illustrated in FIG. 25.

Figure 25:
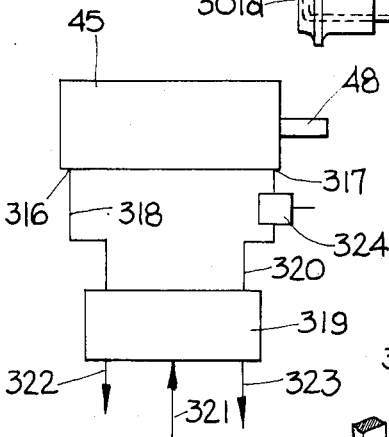
FIG. 25 is a simplified diagrammatic representation of the air cylinder of the present invention together with an associated control valve and restricting valve.

In FIG. 25 cylinder 45 is diagrammatically indicated, together with its piston-piston rod assembly 48. Orifice 316 is connected by conduit 318 to control valve 319. Similarly, orifice 317 is connected to control valve 319 by a conduit 320. Control valve 319 is connected to a source of air under pressure via conduit 321 and is connected to exhaust or a reservoir by conduits 322 and 323.

The line 320 contains a restricting valve 324. Restricting valve 324 is of such nature that when air from source 321 is introduced via conduit 320 to the port 317 of cylinder 45, the restricting valve 324 will allow free passage of such air. However, when exhaust air exits cylinder port 317, the majority of it will be restricted and diverted by restricting valve 324. Thus, in operation, during a door-opening sequence, valve 319 is shifted so as to connect conduit 318 and cylinder port 316 to conduit 321 from the source of air under pressure. In this way, air under pressure is introduced into the cylinder causing piston rod 48 to shift to its extended position, operating the actuating beam and opening the doors. The air within cylinder 45 ahead of the piston will exit via port 317 and the majority of it will pass through and be diverted by restricting valve 324 which, in essence, meters the passage of the exhaust air to assure that cylinder 45 provides a cushioning effect during the door-opening sequence. Some of the exhaust air will pass through conduit 320 which, in the door-open position of valve 319, is connected to exhaust conduit 323. During a door closing sequence, valve 319 will be shifted to its door-closed position wherein conduit 321 from the source of air under pressure is connected by valve 319 to conduit 320 and passes unobstructed through restricting valve 324 to port 317 and into cylinder 45 to shift the piston and piston rod assembly 48 to its door-closed position. Air behind the piston will pass through cylinder port 316 and conduit 318 which is connected to exhaust conduit 322 when the main control valve 319 is in its door-closed position. Restricting valve 324 may be adjustable if desired and the regulated cushioning effect obtained will minimize the wear and stress sustained by the door actuating mechanism and its associated parts.

Figure 26:
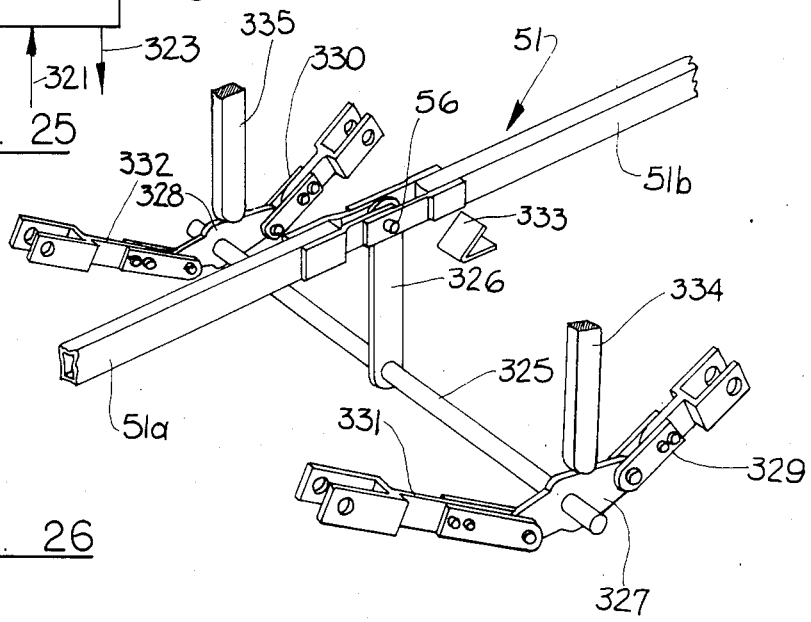
FIG. 26 is a simplified perspective representation of another embodiment of the present invention.

In the previously mentioned U.S. Pat. No. 3,596,609, the door actuating mechanism is such that a link assembly equivalent to link assemblies 111 and 116 of FIG. 4 is affixed to each panel of each door actuated by a given lever. This arrangement is desirable particularly where the door structures are very large and very heavy, the lading is very heavy or where the lading is of such nature that it might freeze to the door panels. As is taught in U.S. Pat. No. 3,596,609, the link assemblies are so arranged as to slightly flex the door panels during a door-opening sequence, tending to break away from the door panels that portion of the lading frozen thereto. A similar arrangement can be provided in the door actuating mechanism of the present invention, as is illustrated in FIG. 26. In FIG. 26 actuating beam segments 51*a* and 51*b* of FIG. 4 are shown together with the connectrng pivot pin 56. A shaft 325 is provided, equivalent to shaft 105. In this instance, however, the shaft 325 extends tranversely of the car beyond the confines of center sill 8, and is rotatively supported by brackets (not shown) depending from appropriate portions of the car body frame.

Non-rotatively mounted on shaft 325 is a center lever 326. The upper end of center lever 326 is pivotally connected to actuating beam 51 by pivot pin 56. The upper end of center lever 326 may be provided with an adjustment means similar to adjustment means 84 of FIGS. 12 through 14, and serving the same purpose.

A pair of door levers 327 and 328 are non-rotatively mounted on shaft 325. It will be apparent from FIG. 26 that center lever 326 is equivalent to the upstanding arm 104*b* of lever 104 of FIG. 4, while the door levers 327 and 328 are each equivalent to arms 104*a* and 104*c* of lever 104 of FIG. 4. One end of each door lever 327 and 328 is provided with a link assembly 329 and 330, respectively. The link assemblies 329 and 330 are each equivalent to link assembly 116 of FIG. 4. In similar fashion, the opposite ends of door lever 327 and 328 are provided with link assemblies 331 and 332, respectively. The link assemblies 331 and 332 are each equivalent to link assembly 111 of FIG. 4.

Link assemblies 329 and 330 will each be pivotally affixed to one of the panels of an adjacent door (not shown). Similarly, link assemblies 331 and 332 will each be pivotally attached to one of the door panels of a door (not shown) adjacent thereto. The center lever 326 can be provided with a stop member 333 equivalent to stop member 96 of FIG. 3 to determine the open position of the hopper doors. Stop member 333 can be mounted on the center sill (not shown). Door levers 327 and 328 can be provided with stop members 334 and 335 to determine the closed position of the doors. Stop members 334 and 335 will be affixed to and will depend from the hopper car frame (not shown).

It will be apparent from FIG. 26 that the lever 104 of FIG. 4 has been broken up into three parts, i.e., center lever 326 and door levers 327 and 328. Aside from this and the fact that each of link assemblies 329 through 332 is connected near the transverse center of a door panel, the operation of the assembly of FIG. 26 is identical to that described with respect to lever 104 and link assemblies 111 and 116 of FIG. 4. It will be understood that the same modifications may be made to all of the levers of the door actuating system.

Modifications may be made in the invention without departing from the spirit of it. For example, cylinder 45 is described as an air cylinder. Cylinder 45 could be a hydraulic cylinder. In fact any appropriate prime mover could be substituted for air cylinder 45 so long as it was capable of imparting controlled linear motion to actuating beam 51. The same is, of course, true of all of he embodiments described herein. While the prime mover is preferably located within the center sill of the hopper car, it can be located elsewhere if its size or nature precludes its location within the center sill.

What is claimed is:

1. A hopper car of the type having a frame including a center sill and a plurality of hopper doors extending transversely of said center sill, and apparatus for actuating and lockng said hopper doors, each hopper door comprising a pair of closure panels located to each side of said center sill and joined together by bracing members, said actuating and locking means comprising a plurality of shafts each located adjacent the exterior surface of at least one hopper door, each of said shafts extending transversely of said center sill and being rotatively mounted therebelow, a lever means non-rotatively mounted on each of said shafts, each of said lever means having at least an outwardly extending arm for each adjacent hopper door and a link pivotally attaching said outwardly extending arm to said adjacent hopper door, each of said links being adjustable in length, a segmented actuating beam located within said center sill and extending longitudinally thereof, each of said lever means having an upstanding arm extending within said center sill, said upstanding arm of each lever means being pivotally attached to said beam, said beam being shiftable longitudinally between a first position wherein all of said lever means, links and hopper doors are maintained in an over-center, locked, door-closed position and a second position wherein all of said lever means, links and hopper doors are rotated over-center to a door-open position, prime mover means operatively connected to said beam to shift said beam between said first and second positions and stop means on said hopper car frame for each of said lever means contacting said upstanding arm thereof to determine the open position of each of said hopper doors controlled thereby and contacting an outwardly extending arm thereof to determine the over-center closed and locked position of each of said hopper doors controlled thereby.

2. The hopper car and actuating and locking appartus claimed in claim 1 wherein each of said lever means comprises an integral, one-piece structure.

3. The hopper car and actuating and locking apparatus claimed in claim 2 wherein said center sill has a horizontal base portion and downwardly depending legs, each terminating in outwardly extending flanges providing said center sill with a hat-shaped cross sectional configuration.

4. The hopper car and actuating and locking apparatus claimed in claim 2 wherein said center sill comprises a longitudinal central portion and longitudinal end portions affixed to the ends of said central portion, said central portion having a horizontal base portion and downwardly depending legs terminating in inturned opposed flanges, each of said end portions having a base portion and downwardly depending legs terminating in outwardly directed flanges to provide said end portions with a hat-shaped cross sectional configuration.

5. The hopper car and actuating and locking means claimed in claim 2 wherein said prime mover comprises a fluid cylinder mounted within said center sill, said fluid cylinder having a piston rod-piston assembly operatively attached to one end of said segmented beam.

6. The hopper car and actuating and locking apparatus claimed in claim 2 including releasable latch means for maintaining said segmented beam in said first door-closed position.

7. The hopper car and actuating and locking apparatus claimed in claim 2 wherein said segments of said beam are pivotally joined together by pivot pins, each of said pivot pins passing through a perforation in the free end of one of said upstanding lever arms.

8. The hopper car and actuating and locking apparatus claimed in claim 13 wherein said perforation in said free end of each of said upstanding lever arms is eccentrically located in a regularly shaped adjustment member selectively engageable in a correspondingly configured socket in said free end of said upstanding lever arm in a plurality of rotative positions.

9. The hopper car and actuating and locking apparatus claimed in claim 2 wherein each of said stop means comprises an angle iron member having an upstanding leg and a substantially horizontal leg, means to mount said angle iron member transversely of and partially within said center sill, said upstanding leg having an abutment surface for said upstanding lever arm of its respective lever means to determine said door-open position of said at least one door controlled by its respective lever means, said substantially horizontal leg having an abutment surface for one of said outwardly extending arms of its respective lever means to determine said door-closed position of said at least one door controlled by its respective lever means.

10. The hopper car and actuating and locking apparatus claimed in claim 2 wherein said prime mover comprises an air cylinder having a piston-piston rod assembly, said air cylinder being mounted within said center sill, said piston-piston rod assembly being operatively attached to one end of said segmented beam.

11. The structure claimed in claim 10 wherein said air cylinder has a forward end through which said piston rod of said piston-piston rod assembly extends and a rearward end, an inlet-outlet port at each of said forward and rearward ends of said air cylinder, a source of air under pressure, a control valve means connecting said forward end port to said source of air and said rearward end port to exhaust to shift said segmented beam from said second door-open position to said first door-closed position and connecting said rearward end port to said air source and said forward end port to exhaust to shift said segmented beam to said second door-open position, restricting valve means in association with said forward end port to restrict exhausting air therefrom whereby said air cylinder and its piston-piston rod assembly will provide a cushioning effect for said hopper doors when shifted from said door-closed to said door-open position.

12. The hopper car and actuating and locking mechanism claimed in claim 10 including a releasable latch means pivotally mounted to said air cylinder and engageable with said end of said segmented beam to which said piston-piston rod is operatively attached to latch said segmented beam in its first door-closed position, spring means biasing said latch means to a beam latching position, said latch means having cam surfaces thereon cooperating with said piston-piston rod assembly to release said latch means during a door-opening sequence.

13. The hopper car and actuating and locking apparatus claimed in claim 10 wherein said segmented beam comprises a plurality of segments pivotally joined together by pivot pins, each of said pivot pins passing through a performation in the free end of one of said upstanding lever arms.

14. The hopper car and actuating and locking apparatus claimed in claim 13 wherein each of said stop means comprises an angle iron member having an upstanding leg and a substantially horizontal leg, means to mount said angle iron member transversely of and partially within said center sill, said upstanding leg having an abutment surface for said upstanding lever arm of its respective lever means to determine said door-open position of said at least one door controlled by its respective lever means, said substantially horizontal leg having an abutment surface for one of said outwardly extending arms of its respective lever means to determine said door-closed position of said at least one door controlled by its respective lever means.

15. The hopper car and actuating and locking apparatus claimed in claim 14 wherein said perforation in said free end of each of said upstanding lever arms is eccentrically located in a toothed adjustment member selectively engagable in a correspondingly configured socket in said free end of said upstanding lever arm.

16. The structure claimed in claim 15 wherein said air cylinder has a forward end through which said piston rod of said piston-piston rod assembly extends and a rearward end, an inlet-outlet port at each of said forward and rearward ends of said air cylinder, a source of air under pressure, a control valve means connecting said forward end port to said source of air and said rearward end port to exhaust to shift said segmented beam from said second door-open position to said first door-closed position and connecting said rearward end port to said air source and said forward end port to exhaust to shift said segmented beam to said second door-open position, restricting valve means in association with said forward end port to restrict exhausting air therefrom whereby said air cylinder and its piston-piston rod assembly will provide a cushioning effect for said hopper doors when shifted from said door-closed to said door-open position.

17. The hopper car and actuating and locking mechanism claimed in claim 15 including a releasable latch means pivotally mounted to said air cylinder and engageble with said end of said segmented beam to which said piston-piston rod is operatively attached to latch said segmented beam in its first door-closed position, spring means biasing said latch means to a beam latching position, said latch means having cam surfaces thereon cooperating with said piston-piston rod assembly to release said latch during a door-opening sequence.

18. The hopper car and actuating and locking apparatus claimed in claim 17 wherein said center sill has a horizontal base portion and downwardly depending legs, each terminating in outwardly extending flanges providing said center sill with a hat-shaped cross sectional configuration.

19. The hopper car and actuating and locking apparatus claimed in claim 17 wherein said center sill comprises a longitudinal central portion and longitudinal end portions affixed to the ends of said central portion, said central portion having a horizontal base portion and downwardly depending legs terminating in inturned opposed flanges, each of said end portions having a base portion and downwardly depending legs terminating in outwardly directed flanges to provide said end portions with a hat-shaped cross sectional configuration.

20. The hopper car and actauting and locking apparatus claimed in claim 1 wherein each of said lever means comprises a center lever and first and second door levers, said center lever being non-rotatively affixed to said shaft beneath said center sill and comprising said upstanding arm, said first and second door levers being non-rotatively affixed to said shaft outboard of said center lever and to each side of said center sill, each of said door levers having an outwardly extending arm for each adjacent hopper door pivotally connected to a panel of its respective adjacent hopper door by one of said adjustable length links.

21. The hopper car and actuating and locking apparatus claimed in claim 1 wherein said center sill has a horizontal base portion and downwardly depending legs, each terminating in outwardly extending flanges providing said center sill with a hat-shaped cross sectional configuration.

22. The hopper car and actuating and locking apparatus claimed in claim 1 wherein said center sill comprises a longitudinal central portion and longitudinal end portions affixed to the ends of said central portion, said central portion having a horizontal base portion and downwardly depending legs terminating in inturned opposed flanges, each of said end portions having a base portion and downwardly depending legs terminating in outwardly directed flanges to provide said end portions with a hat-shaped cross sectional configuration.

23. The hopper car and actuating and locking means claimed in claim 1 wherein said prime mover comprises a fluid cylinder mounted within said center sill, said fluid cylinder having a piston rod-piston assembly operatively attached to one end of said segmented beam.

24. The hopper car and actuating and locking apparatus claimed in claim 1 including releasable latch means for maintaining said segmented beam in said first door-closed position.

25. The hopper car and actuating and locking apparatus claimed in claim 1 including means whereby said pivotal attachment of each of said upstanding arms and said segmented beam is adjustable.

26. The hopper and actuating and locking apparatus claimed in claim 1 wherein said hopper car is chosen from the class consisting of hopper cars having hopper doors arranged singly to close a chute, hopper cars having hopper doors arranged in opposed pairs cooperating with hopper sheets to form a chute, and hopper cars having both hopper door arrangements, each said shaft being located between the exterior surfaces of adjacent hopper doors of adjacent pairs thereof when said hopper doors are so arranged and adjacent the exterior surface of each single hopper door when present.

27. A hopper car of the type having a center sill and a plurality of hopper doors extending transversely of said center sill, and apparatus for actuating and locking said hopper doors, each hopper door comprising a pair of closure panels located to each side of said center sill and joined together by bracing members, said actuating and locking means comprising a plurality of shafts each located adjacent the exterior surface of at least one hopper door, each of said shafts extending transversely of said center sill and being rotatively mounted therebelow, an integral one-piece lever non-rotatively mounted on each of said shafts, each of said levers having an outwardly extending arm for each adjacent hopper door and a link pivotally attaching said outwardly extending arm to said adjacent hopper door, an actuating beam located within said center sill and extending longitudinally thereof, each of said levers having an an upstanding arm extending within said center sill, said upstanding arm of each lever being pivotally attached to said beam, said beam being shiftable longitudinally between a first position wherein all of said levers, links and hopper doors are maintained in an over-center, locked, door-closed position and a second position wherein all of said levers, links and hopper doors are rotated over-center to a door-open position, prime mover means operatively connected to said beam to shift said beam between said first and second positions and stop means for each of said levers contacting said upstanding arm thereof to determine the open position of each of said hopper doors controlled thereby and contacting one of said outwardly extending arms thereof to determine the over-center closed and locked position of each of said hopper doors controlled thereby.

28. The hopper car and actuating and locking apparatus claimed in claim 27 wherein said prime mover is located within said center sill.

29. The hopper car and actuating and locking apparatus claimed in claim 27 wherein said prime mover is an air cylinder having a piston-piston rod assembly, said air cylinder having a forward end through which said piston rod of said piston-piston rod assembly extends and a rearward end, an inlet-outlet port at each of said forward and rearward ends of said air cylinder, a source of air under pressure, a control valve means connecting said forward end port to said source of air and said rearward end port to exhaust to shift said beam from said second door-open position to said first door-closed position and connecting said rearward end port to said air source and said forward end port to exhaust to shift said beam to said second door-open position, restricting valve means in association with said forward end port to restrict exhausting air therefrom whereby said air cylinder and its piston-piston rod assembly will provide a cushioning effect for said hopper doors when shifted from said door-closed to said door-open position.

30. The hopper car and actuating and locking apparatus claimed in claim 27 wherein said hopper car is chosen from the class consisting of hopper cars having hopper doors arranged singly to close a chute, hopper cars having hopper doors arranged in opposed pairs copperating with hopper sheets to form a chute, and hopper cars having both hopper door arrangements, each said shaft being located between the exterior surfaces of adjacent hopper doors of adjacent pairs thereof when said hopper doors are so arranged and adjacent the exterior surface of each single hopper door when present.

31. A hopper car of the type having a center sill and a plurality of hopper doors extending transversely of said center sill, and apparatus for actuating and locking said hopper doors, each hopper door comprising a pair of closure panels located to each side of said center sill and joined together by bracing members, said actuating and locking means comprising a adjacent the exterior a plurality of shafts each located surface of at least one hopper door, each of said shafts extending transversely of said center sill and being rotatively mounted therebelow, a lever means non-rotatively mounted on each of said shafts, each of said lever means having at least an outwardly extending arm for each adjacent hopper door and a link pivotally attaching said outwardly extending arm to said adjacent hopper door, an actuating beam located within said center sill and extending longitudinally thereof, each of said lever means having an upstanding arm extending within said center sill, said upstanding arm of each lever means being pivotally attached to said beam, said beam being shiftable longitudinally between a first position wherein all of said lever means, links and hopper doors are maintained in an over-center, locked, door-closed position and a second position wherein all of said lever means, links and hopper doors are rotated over-center to a door-open position, prime mover means located within said center sill and operatively connected to said beam to shift said beam between said first and second positions and stop means for each of said lever means contacting said upstanding arm thereof to determine the open position of each of said hopper doors controlled thereby and contacting an outwardly extending arm thereof to determine the over-center closed and locked position of each of said hopper doors controlled thereby.

32. The hopper car and actuating and locking apparatus claimed in claim 31 wherein said prime mover is an air cylinder having a piston-piston rod assembly, said air cylinder having a forward end through which said Piston rod of said piston-piston rod assembly extends and a rearward end, an inlet-outlet port at each of said forward and rearward ends of said air cylinder, a source of air under pressure, a control valve means connecting said forward end port to said source of air and said rearward end port to exhaust to shift said beam from said second door-open position to said first door-closed position and connecting said rearward end port to said air source and said forward end port to exhaust to shift said beam to said second door-open position, restricting valve means in association with said forward end port to restrict exhausting air therefrom whereby said air cylinder and its piston-piston rod assembly will provide a cushioning effect for said hopper doors when shifted from said door-closed to said door-open position.

33. The hopper car and actuating and locking apparatus claimed in claim 31 wherein said hopper car is chosen from the class consisting of hopper cars having hopper doors arranged singly to close a chute, hopper cars having hopper doors arranged in opposed pairs cooperating with hopper sheets to form a chute, and hopper cars having both hopper door arrangements, each said shaft being located between the exterior surfaces of adjacent hopper doors of adjacent pairs thereof when said hopper doors are so arranged and adjacent the exterior surface of each single hopper door when present.

* * * * *